US005659863A

United States Patent [19]

Kawabata et al.

[11] Patent Number: 5,659,863

[45] Date of Patent: Aug. 19, 1997

[54] IMAGING FORMING APPARATUS WITH DETECTING CAPABILITIES OF A CONDITION OF A TRANSFER MATERIAL CARRIER

[75] Inventors: Takashi Kawabata; Nobuo Hyakutake; Fumio Furusawa; Masaaki Tokunaga; Ryoichi Tsuruoka, all of Ebina, Japan

[73] Assignee: Fuji Xerox Co., Ltd., Tokyo, Japan

[21] Appl. No.: 573,496

[22] Filed: Dec. 15, 1995

[30] Foreign Application Priority Data

Dec. 19, 1994 [JP] Japan ..... 6-315294

[51] Int. Cl.[6] ..... G03G 15/14

[52] U.S. Cl. ..... 399/303

[58] Field of Search ..... 355/271, 277, 355/208, 296, 274; 399/297, 397, 34, 71, 18, 303, 304, 312, 398, 399

[56] References Cited

U.S. PATENT DOCUMENTS 5,019,871 5/1991 Takeda et al. ..... 399/304 X 5,172,172 12/1992 Amemiya et al. ..... 399/303

5,335,053 8/1994 Hasegawa ..... 399/303 X

FOREIGN PATENT DOCUMENTS 62-280883 12/1987 Japan .

*Primary Examiner*—Shuk Lee

*Attorney, Agent, or Firm*—Oliff & Berridge

[57] ABSTRACT

An image forming apparatus capable of preventing a transfer material detecting unit from making any detection error when the surface of a transfer drum becomes opaque, and restraining transfer film replacement intervals from being shortened with a simple constitution. The image forming apparatus is provided with a transfer material detecting unit for detecting conditions in which a transfer material is conveyed on a transfer material carrier, and a transfer material peeling unit for peeling the transfer material off the transfer material carrier by contacting the surface of the transfer material carrier. At least part of the transfer material peeling unit is disposed so that it at least linearly contacts the axial surface of the transfer material carrier at the same position as that of the transfer material detecting unit in the axial direction of the transfer material carrier.

16 Claims, 21 Drawing Sheets

IMAGING FORMING APPARATUS WITH DETECTING CAPABILITIES OF A CONDITION OF A TRANSFER MATERIAL CARRIER

BACKGROUND OF THE INVENTION

The present invention relates to an image forming apparatus such as an electrophotographic copying apparatus and a printing apparatus for forming an image by successively forming a plurality of toner images different in color on a photosensitive drum and transferring the plurality of toner images formed on the photosensitive drum in such a manner as to superpose the toner images successively on a transfer material held on a transfer drum, and more particularly to the art of preventing nonconformity detecting means for detecting the transfer material conveyed to the transfer drum in nonconforming condition from making any detection error.

A typical image forming apparatus of the sort which employs a transfer drum is used for forming an image by successively forming a plurality of toner images different in color, for example, images of cyan, magenta, yellow, black and the like, on a photosensitive drum and transferring the plurality of toner images formed on the photosensitive drum so as to superpose the toner images successively on a transfer material such as transfer paper held on a transfer drum. In the image forming apparatus, a predetermined number of toner images are transferred in a multiplex mode onto the transfer material absorbed onto the transfer drum and then the transfer material is peeled off the surface of the transfer drum, whereby the toner image is fixed on the transfer material by means of a fixing unit. In such an image forming apparatus, further, a copy can be made on both sides of the transfer material by turning the transfer material with the toner image formed on one side upside down and feeding it again.

In the image forming apparatus, a nonconformity detecting means is also used for detecting whether the transfer material is properly held on the surface of the transfer drum or whether the transfer material has been peeled off the surface of the transfer drum for certain. In the image forming apparatus, further, a cleaning unit is used for cleaning the surface of the transfer drum because floating toner, the extraneous additive of the toner or paper powder originating from transfer paper as the transfer material tend to stick to the surface of the transfer drum.

A transfer material 101 supplied from a paper feed cassette (not shown) is pressed by an absorption roll 102 against the surface of the transfer drum 100 as shown in FIG. 14. The transfer material 101 is charged by an absorption corotron 103 from the back side of the transfer drum 100 and electrostatically absorbed. Further, toner images formed on a photosensitive drum 104 are successively transferred onto the transfer material 101 absorbed onto the surface of the transfer drum 100, and the transfer material 101 is peeled by a peeling unit 105 from the surface of the transfer drum 100. The toner image is then fixed on the transfer material 101 by a fixing unit 106. Thus the image-forming process is terminated.

In that case, jam sensors 107, 108, 109 are arranged on the outer periphery of the transfer drum 100: the jam sensor 107 installed on the downstream side of the absorption roll 102 is used for detecting whether the transfer material 101 is absorbed onto the surface of the transfer drum 100; the jam sensor 108 installed on the downstream side of the photosensitive drum 104 and its nip portion is used for detecting whether the transfer material 101 is held on the surface of the transfer drum 100; and the jam sensor 109 installed on the downstream side of the peeling unit 105 is used for detecting whether the transfer material 101 has been peeled off the surface of the transfer drum 100. As disclosed in Unexamined Japanese Patent Publication 62-280883/(1987), for example, a cleaning brush 110 for cleaning the surface of the transfer drum 100 is arranged on the outer periphery of the transfer drum 100.

However, there is a problem arising from the prior art as follows: When the transfer material 101 with the plurality of toner images different in color, that is, toner images of cyan, magenta, yellow, black and the like transferred thereto is fixed by the fixing unit 106 in the case of the conventional image forming apparatus, a releasing agent such as silicone oil greater in quantity than what is used for a normal black and white copy is used to restrain the toner from being offset on the transfer material 101, and the releasing agent also sticks onto the transfer material 101. For this reason, the surface of the transfer material 101 on which the toner image has been formed may touch that of the transfer drum 100 particularly when both-side printing is made in the image forming apparatus of the sort mentioned above and this may cause the releasing agent sticking onto the transfer material 101 to stick to the surface of the transfer drum 100 likewise. Then the releasing agent sticking to the surface of the transfer drum 100 acts as an adhesive and this allows the floating toner and the extraneous additive of the toner or otherwise paper powder originating from transfer paper as the transfer material 101, for example, to stick onto the surface of the transfer drum 100.

Like this, the floating toner and the extraneous additive of the toner or otherwise the transfer paper powder produced from the transfer material 101, particularly the extraneous additive of the toner and the paper powder having a small particle size are impossible to remove completely by the cleaning brush 110 and as they gradually accumulate on the surface of the transfer drum 100, thus making the surface of the transfer drum 100 become opaque. When the surface of the transfer drum 100 becomes opaque, the detection level of jam sensors 107, 108, 109 disposed on the outer periphery of the transfer drum 100 lowers, thus causing the jam sensors to make a detection error. Consequently, the problem is that a replacement interval of a transfer film 100*a* is shortened because the equipment may stop operating properly unless the transfer film 100*a* on the surface of the transfer drum 100 is replaced. This problem is found noticeable particularly when a copy is made on both sides of the transfer material in the image forming apparatus above. However, the extraneous additive of the tone and the paper powder gradually accumulate on the surface of the transfer drum even when both-side printing is not made and the surface of the transfer drum gradually becomes opaque likewise, which also poses a similar problem.

In the image forming apparatus using such a transfer drum, moreover, use may also be made of a concentration detecting means for detecting the toner concentration of a test patch on the transfer drum 100 by transferring the test patch onto the transfer drum 100 as occasion demands in addition to the transfer material detecting means such as the jam sensor 107 and so on for detecting the conditions in which the transfer material 101 is conveyed on the transfer drum 100. The opaque condition of the surface of the transfer drum 100 may become the cause of a detection error at the time the toner concentration of the test patch is detected.

SUMMARY OF THE INVENTION

An object of the present invention made to solve the foregoing problems in the prior art is to provided an image forming apparatus capable of preventing a transfer material detecting means or a concentration detecting means from making any detection error when the surface of a transfer drum becomes opaque, and restraining transfer film replacement intervals from being shortened with a simple constitution.

According to the image forming apparatus of the invention comprises a detecting means for optically detecting a condition of an outer surface of the transfer material carrier by use of a beam spot light; and first cleaning means for cleaning the transfer material carrier installed at the same position as position of the detecting means in the axial direction of the transfer material carrier, an axial length of the first cleaning means being greater than a diameter of the beam spot light of the detecting means and smaller than a effective image width of the image forming apparatus, the first cleaning means being capable of contacting onto and separating from the transfer material carrier. Therefore, it is possible to prevent not only the surface of the transfer material carrier from becoming opaque but also the detecting means from being erroneously detected simply by arranging the first cleaning means at the same position as position of the detecting means in the axial direction of the transfer material carrier.

Moreover, the axial length of the first cleaning means is set greater than the diameter of the beam spot of the detecting means and smaller than the effective image width to ensure that at least the length equivalent to the diameter of the beam spot of the detection means is cleaned and since the axial length thereof is set smaller than the effective image width, an area equivalent to the detection means is effectively cleaned. Further, as the cleaning means is capable of contacting and separating from the transfer material carrier, the toner image transferred onto the transfer material is made free from any damage.

Further, the axial length of the first cleaning means is not greater than 20 mm, as is obvious from the tests made by present inventors, cleaning efficiency is restrained from being lowered even in a case the axial length above exceeds 20 mm with the effect of making the cleaning means compact; therefore, there is great merit in view of cost.

Moreover, the image forming apparatus further comprises a second cleaning means for cleaning the transfer material carrier over the effective image width, and first cleaning means is disposed on the upstream side of the second cleaning means. Therefore, the toner, the extraneous additive and the paper powder removed by the first cleaning means can be cleaned by the second cleaning means located on the downstream side of the first cleaning means.

Furthermore, the first cleaning means is operated in associated with a member related to feeding and peeling the transfer material on the transfer material carrier. Therefore, it is certainly prevented from causing trouble to the transfer material on the transfer material carrier without using a special member.

Still further, the image forming apparatus of the invention comprises detecting means for optically detecting a condition of an outer surface of the transfer material carrier by use of a beam spot light; and transfer material peeling means for peeling the transfer material off the transfer material carrier by contacting the surface of the transfer material carrier, the transfer material peeling means being disposed so that it linearly contacts the axial surface of the transfer material carrier at the same position as position of the detecting means in the axial direction of the transfer material carrier. Therefore, the extraneous additive of the toner, the paper power and the like are prevented from making the surface of the transfer material carrier become opaque by scraping small particles originating from the extraneous additive of the toner, the paper powder and the like sticking to the surface of the transfer material carrier using the transfer material peeling means in linear contact with the surface of the transfer material carrier, whereby it is possible to prevent the transfer material detecting means or the concentration detecting means from being erroneously detected.

DESCRIPTION OF THE PREFERRED EMBODIMENTS

A description will subsequently be given of the present invention by reference to the embodiments thereof shown in the accompanying drawings.

Embodiment 1

Figure 8:
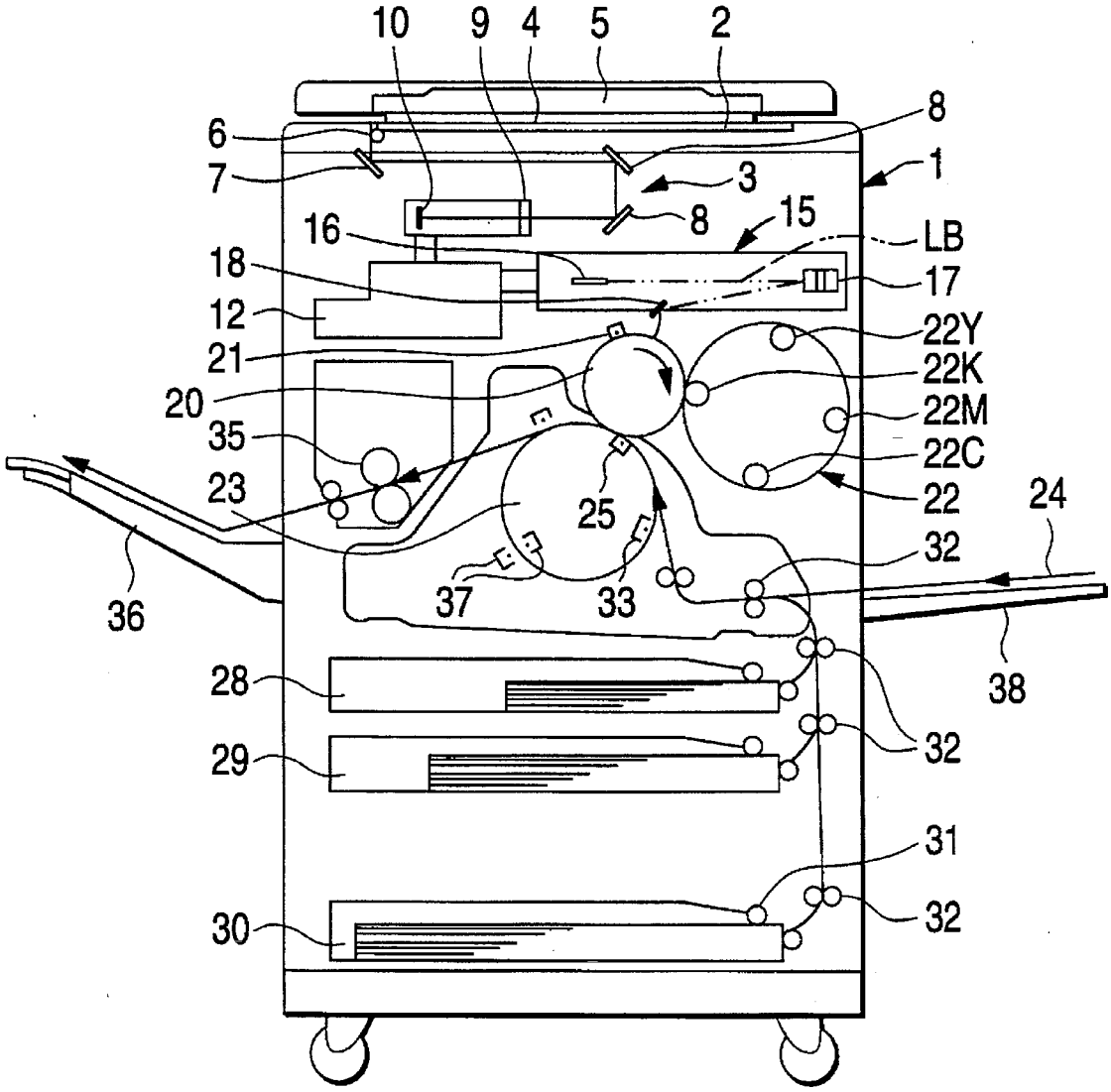
FIG. 8 is a block diagram of an image forming apparatus embodying the present invention.

FIG. 8 shows an image forming apparatus embodying the present invention in the form of a multiple-transfer-type digital color image forming apparatus.

In FIG. 8, reference numeral 1 designates the body of a digital color image forming apparatus, and an image input terminal 3 for reading images on both sides of an original 2 is placed in the upper end portion of the body thereof. With this image input terminal 3, an image of the original 2 mounted on a platen glass 1 is illuminated with a light source 6 while the original 2 is pressed by a platen cover 5 against the platen glass 1. Then the reflected light image of the original 2 formed 2 is scanned and exposed to light in a CCD sensor 10 via a first and a second scanning mirror 7, 8, and an image-forming lens 9. The CCD sensor 10 is adapted for reading the coloring material reflected light image of the original 2 with a predetermined dot density (e.g., 16 dots/mm).

The coloring material reflected light image of the original 2 thus read by the image input terminal 3 is sent to an image processing system 12 in the form of three-color (red (R), green (G), blue (B), each being 8 bits) original reflectance data. In the image processing system 12, there is performed a predetermined imaging process which is based on the original reflectance data on the original 2, the process including shading correction, deviated position correction, lightness/color space conversion, gamma correction, frame erasure, color/moving editing and the like.

The image data subjected to the predetermined imaging process in the image processing system 12 is converted to original coloring material gradation data concerning three colors of black (K), yellow (Y), magenta (M) and cyan (C) (each being 8 bits) before being sent ROS (Raster Output Scanner) 15 in which the image is exposed to light by means of a laser beam in accordance with the original coloring material gradation data.

Figure 18:
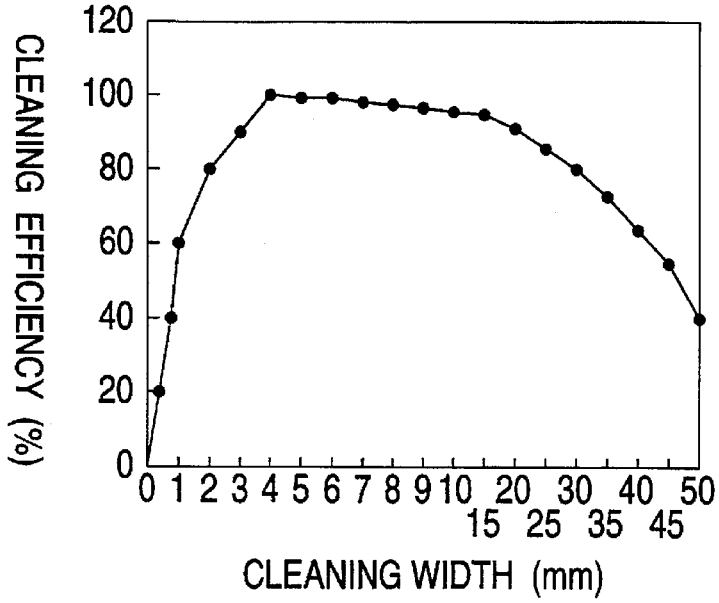
FIG. 18 is a graphic representation showing test results.

As shown in FIG. 18, the ROS 15 modulates a semiconductor laser 16 in accordance with the original coloring material gradation data 14 and makes the semiconductor laser 16 emit the laser beam LB in accordance with the gradation data 14. The laser beam LB emitted from the semiconductor laser 16 is subjected by a rotary polygon mirror 17 to deflection scanning and used for scanning and exposing a photosensitive drum 20 via a reflective mirror 18.

The photosensitive drum 20 thus scanned by and exposed to the laser beam LB through the operation of the ROS 15 is driven by a driving means (not shown) to rotate at a predetermined speed along an arrow. The surface of the photosensitive drum 20 is electrically charged by a charged corotron 21 beforehand with a predetermined potential before being scanned by and exposed to the laser beam LB in accordance with the original coloring material gradation data, whereby a latent image is formed. The latent image formed on the photosensitive drum 20 is successively developed by a rotary developing unit 22 which is provided with four color developers 22K, 22Y, 22M, 22C of black (K), yellow (Y), magenta (M) and cyan (C), which results in forming a toner image having predetermined colors.

The toner image formed on the photosensitive drum 20 is continuously transferred onto transfer paper as a transfer material 24 held on a transfer drum 23 placed adjacent to the photosensitive drum 20 as a transfer corotron 25 is charged. As shown in FIG. 8, the transfer material 24 is supplied out of a plurality of paper feeding cassettes 28, 29, 30 arranged under an image forming apparatus body 1 and can also be fed from a manual-insertion tray 38 placed on the side of the image forming apparatus body 1. The transfer material 24 thus fed is conveyed by a conveying roller 32 up to the surface of the transfer drum 23. While electrostatically absorbed onto the surface of the transfer drum. 23 as a charged corotron 33 becomes charged, it is held on the surface of the transfer drum 23. Incidentally, any transparent OHP sheets of paper and the like for overhead projectors other than nonstandard-size transfer sheets of paper can be fed from the manual-insertion tray 38, so that images may be formed on any OHP sheets and the like. Moreover, it is possible to make a copy on both sides of a sheet of copying paper by first forming an image on one side and then on the other by turning the transfer material 24 upside down.

Moreover, the toner image having a predetermined number of colors is transferred from the photosensitive drum 20 to the transfer material 24 and when a peeling corotron 34 is charged, the transfer material 24 is peeled off the surface of the transfer drum 23 thereby. Then the transfer material 24 is conveyed to a fixing unit 35 where the toner image is fixed on the transfer material 24 by heat and under pressure. Then the transfer material 24 is discharged onto a paper discharge tray 36, so that the whole process of forming a color image is terminated.

In FIG. 8, reference numeral 37 designates a deenergizing corotron for removing the charge of the transfer drum 23.

Figure 1:
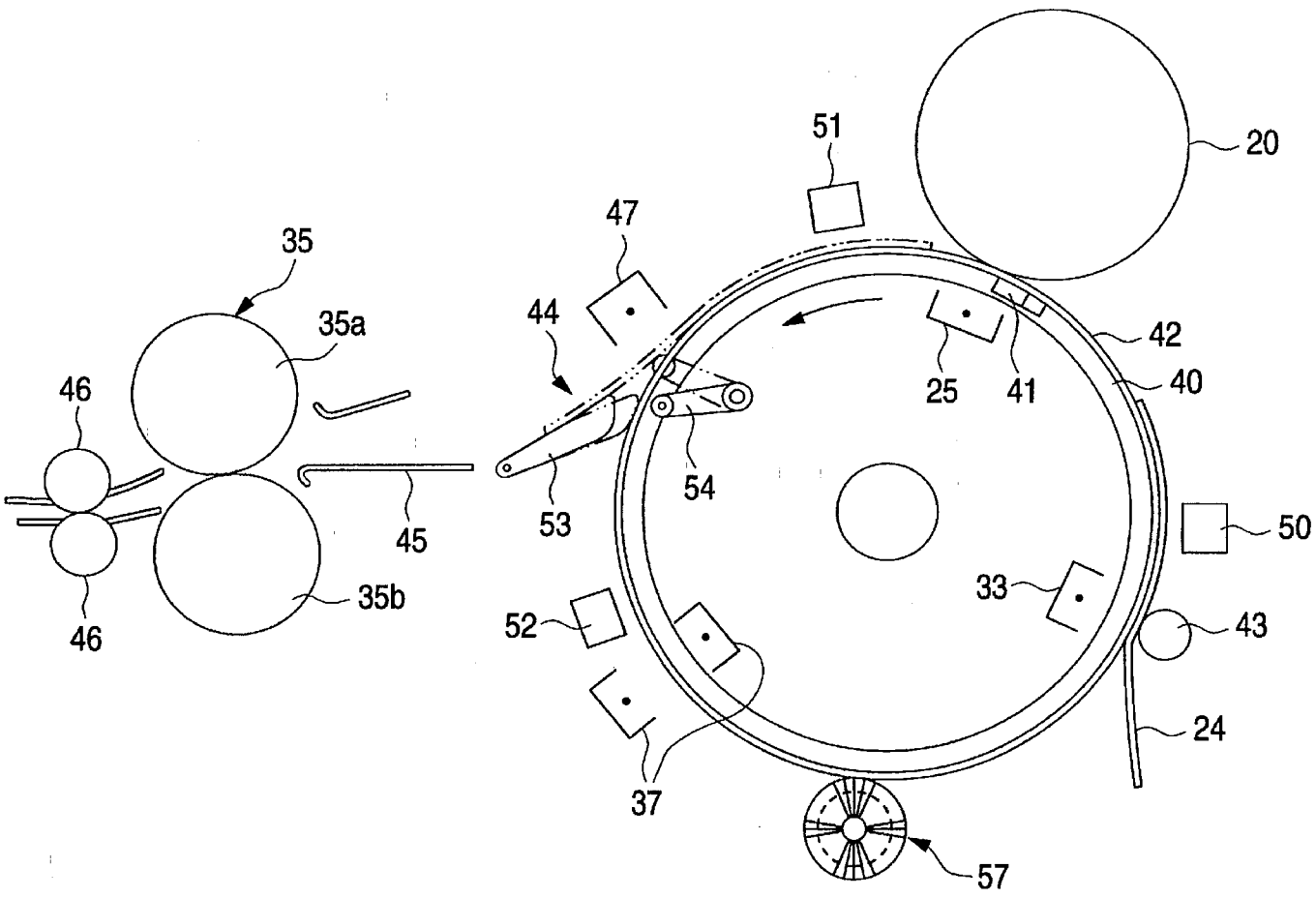
FIG. 1 is a block diagram of an image-forming section of an image forming apparatus embodying the present invention.
Figure 2:
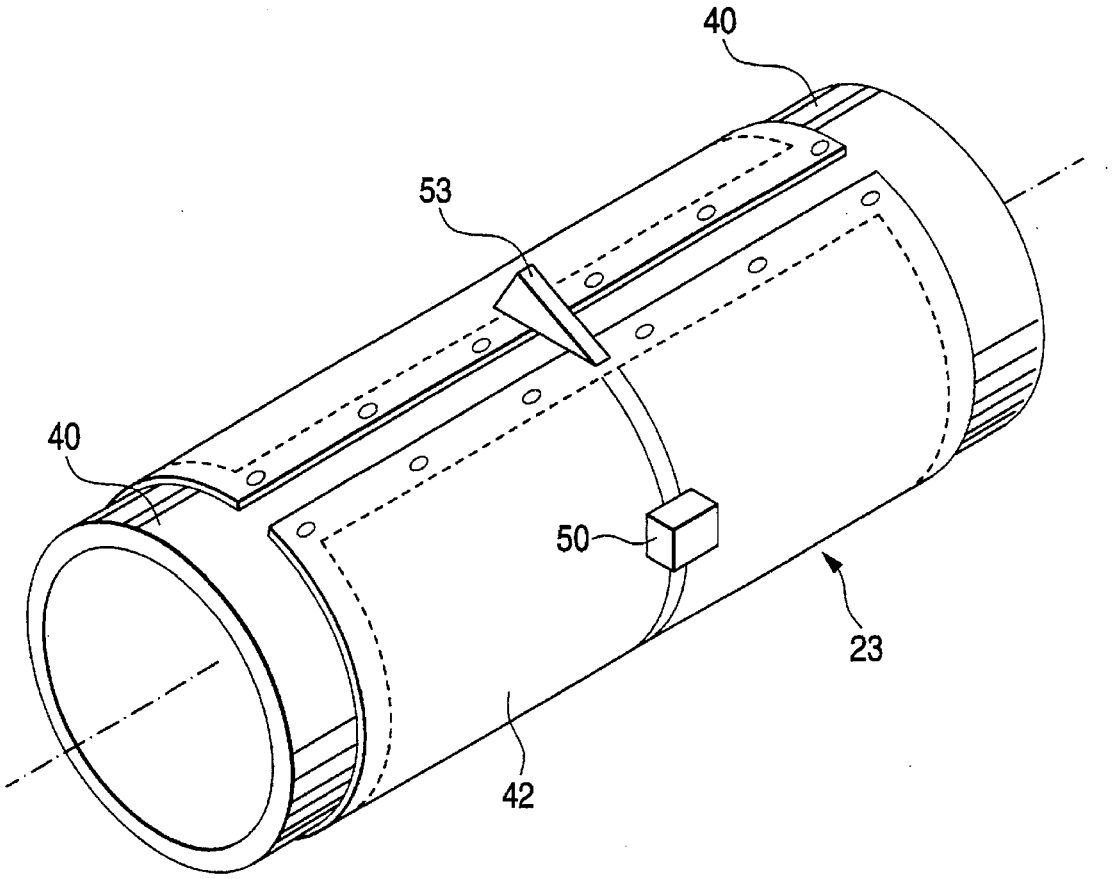
FIG. 2 is a perspective view showing the positional relation between the peeling finger and the jam sensor.

FIG. 1 is a block diagram illustrating an image forming unit of the aforementioned multiple-transfer-type digital color image forming apparatus.

Figure 9:
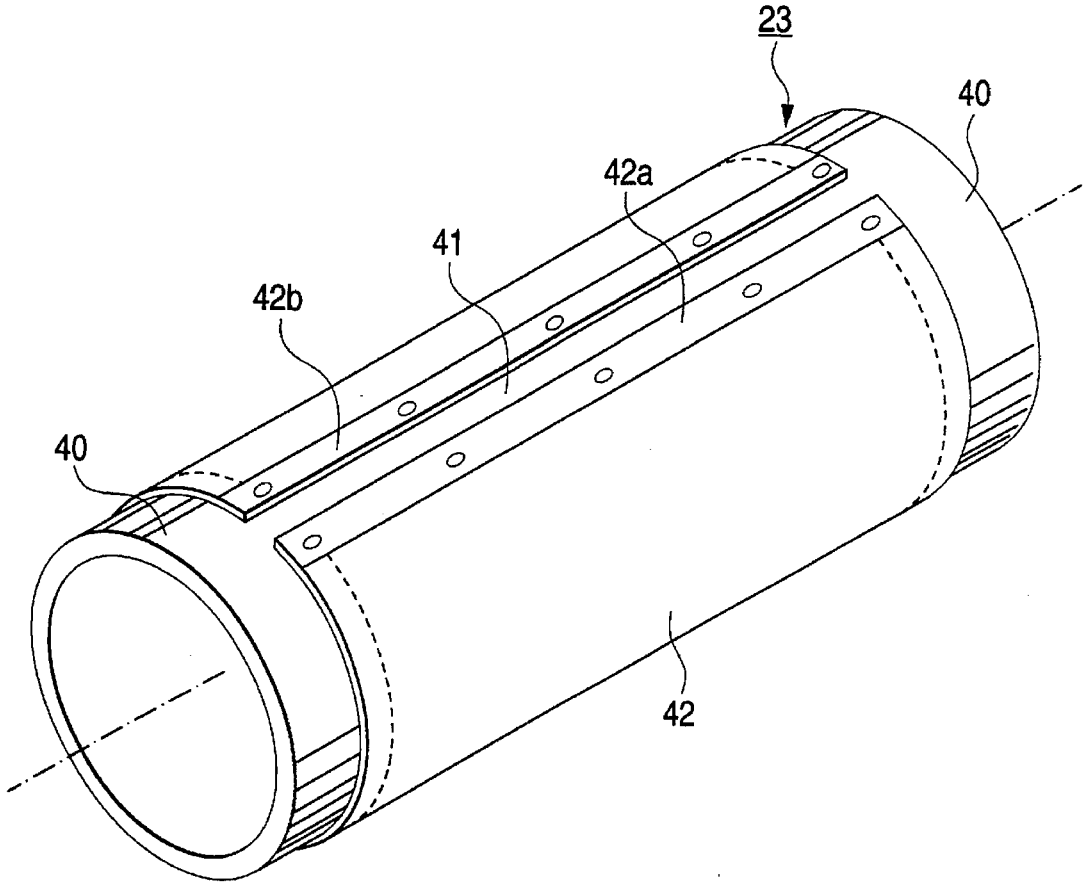
FIG. 9 is a perspective of the transfer drum.

In FIG. 1, reference numeral 20 designates the aforementioned photosensitive drum, and the transfer drum 23 as a transfer material carrier is placed in such a manner as to contact the surface of the photosensitive drum 20. The transfer drum 23 is driven by a driving mechanism to rotate at the same speed as the peripheral speed of the photosensitive drum 20. The transfer drum 23 is, as shown in FIG. 9, provided with a drum-like frame body having not only ring members 40, 40 as a pair of annular members axially disposed at both the end portions thereof but also a tie-bar plate 41 as a coupling member for coupling the ring members 40, 40 together. Further, the front-end edge portion 42*a* in the circumferential direction of a transfer film 42 in the form of a dielectric film of polyethylene terephthalate, polyvinylidene fluoride or the like is secured to the tie-bar plate 41. The both side end portions of the film are wound on the frame body along the outer peripheral faces of the respective ring members 40, 40, and the rear end edge portion 42*b* in the circumferential direction of the transfer film 42 is secured to the tie-bar plate 41, the transfer drum 23 being made cylindrical and hollow.

As shown in FIG. 8, the transfer drum 23 is, as described above, supplied with the transfer material 24 from among the plurality of paper feeding cassettes 28, 29, 30, and the transfer material 24 is pressed by an absorption roll 43 against the surface of the transfer drum 23. The transfer material 24 is charged by the absorption corotron 33 from the rear side of the transfer drum 23 and electrostatically absorbed onto the transfer film 42 of the transfer drum 23. The toner image of black (K), yellow (Y), magenta (M) and cyan (C) successively formed on the photosensitive drum 20 is transferred to the transfer material 24 absorbed onto the transfer drum 23 when the transfer corotron 25 is charged.

After the toner image having the predetermined number of colors is transferred from the photosensitive drum 20 to the transfer material 24, the transfer material 24 is peeled by a peeling unit 44 off the transfer drum 23 before being conveyed via a conveyer guide 45 to the fixing unit 35. The fixing roller 35*a* as well as the pressure roller 35*b* of the fixing unit 35 then causes the toner image to be fixed on the transfer material 24 by heat and under pressure, and the transfer material 24 is discharged by fuser outlet rolls 46 onto the paper discharge tray 36 outside the apparatus.

This embodiment of the invention comprises a transfer material detecting means for detecting conditions in which the transfer material is conveyed on the transfer material carrier or a concentration detecting means for detecting toner concentration on the transfer material carrier, and a transfer material peeling means for peeling the transfer material off the transfer material carrier by contacting the surface of the transfer material carrier. The transfer material peeling means is arranged so that at least it linearly contacts the axial surface of the transfer material carrier at the same position as that of the transfer material detection means or a toner concentration detecting means in the axial direction of the transfer material carrier.

Figure 5:
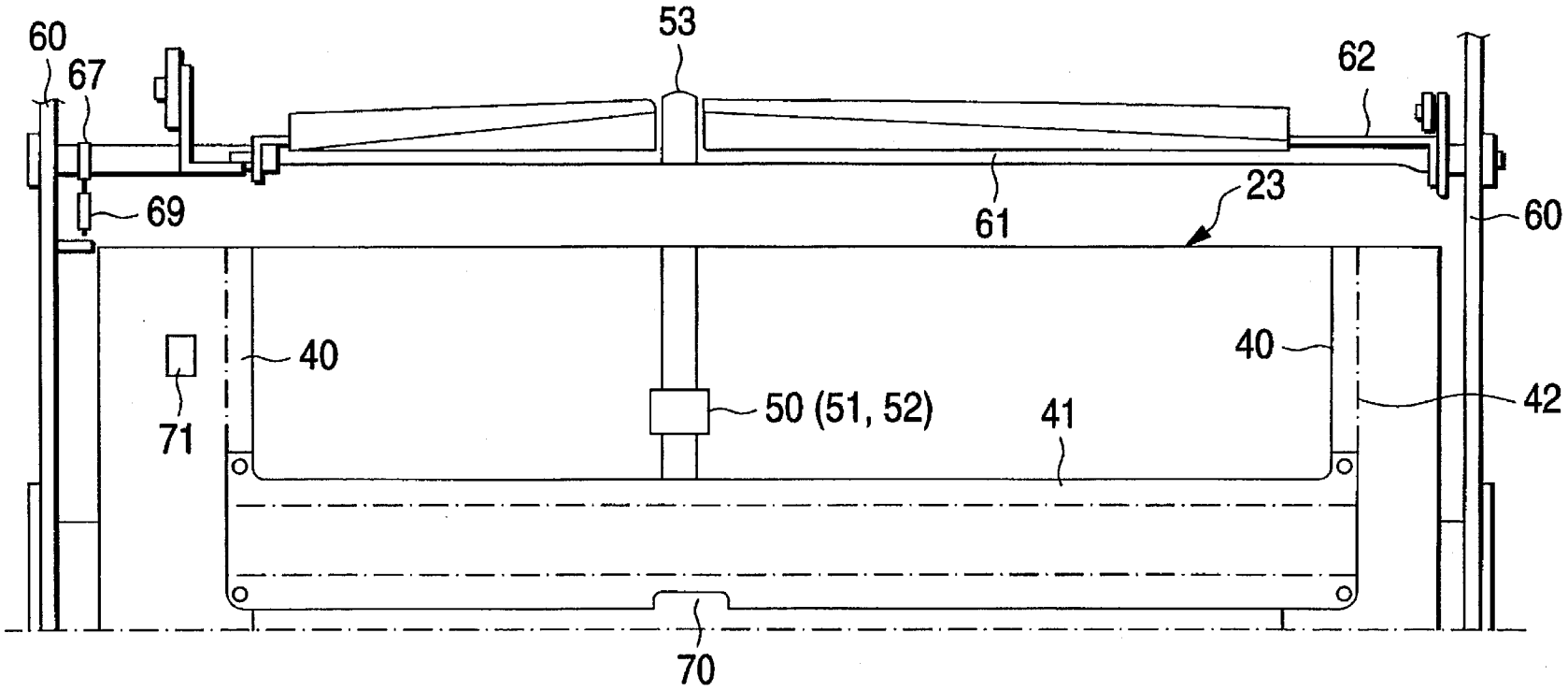
FIG. 5 is an elevational view showing the positional relation between the peeling finger and the jam sensor.

In other words, there are a first, a second and a third jam sensor 50, 51, 52 which are disposed on the outer periphery of the transfer drum 23 on the downstream side of the absorption roll 43: the first jam sensor 50 is used for detecting whether the transfer material 24 has been absorbed onto the surface of the transfer drum 23; the second jam sensor 51 is used for detecting whether the transfer material 24 has been held on the surface of the transfer drum 23 without being moved toward the photosensitive drum 20; and the third jam sensor 52 is used for detecting whether the transfer material 24 has been peeled off the surface of the transfer drum 23. These first, second and third jam sensors 50, 51, 52 are adapted for use in optically detecting whether the transfer material 24 has been held on the surface of the transfer drum 23 by emitting a spot beam about 5 mm in diameter or at least about 3 mm in diameter to the surface of the transfer drum 23, for example, so as to detect diffuse reflection light, regular reflection light and the like from the surface side of the transfer drum 23. Moreover, the first, second and third jam sensors 50, 51, 52 are all disposed at the same position in the axial direction of the transfer drum 23 as shown in FIG. 5.

In the case of a digital color image forming apparatus using such a transfer drum, moreover, use may also be made of a concentration detecting means for detecting the toner concentration of a test patch on the transfer drum 23 by transferring the test patch onto the transfer drum 23 as occasion demands in addition to the transfer material detecting means such as the jam sensor 50 and so on for detecting the conditions in which the transfer material 24 is conveyed on the transfer drum 23.

Figure 3:
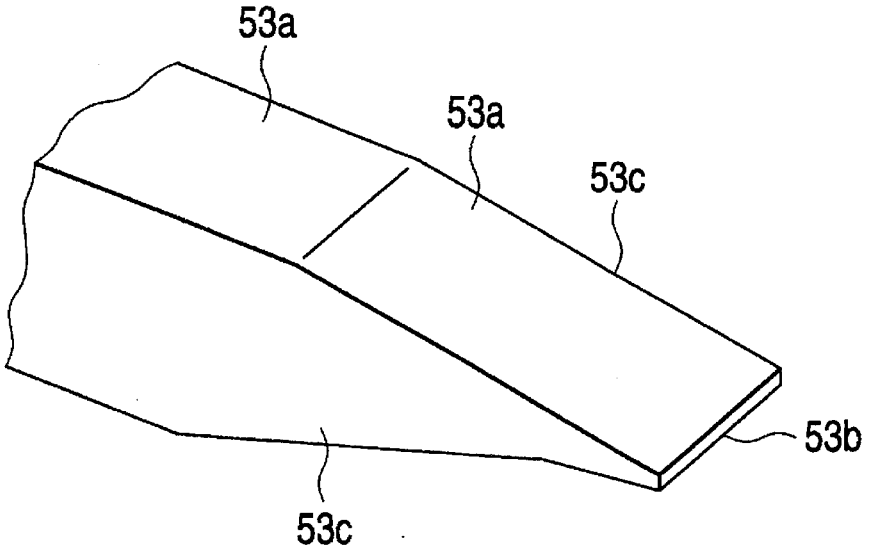
FIG. 3 is a perspective view showing the peeling finger.
Figure 4:
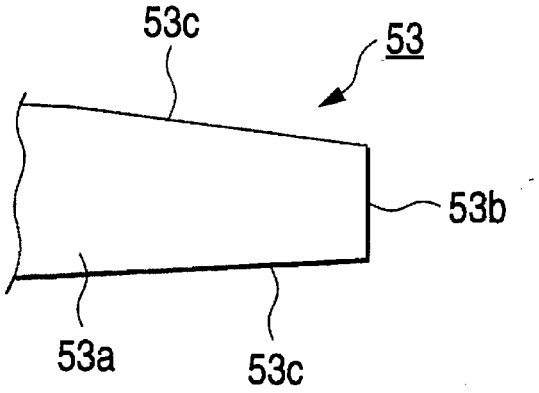
FIG. 4 is a top view showing the leading end portion of the peeling finger.

As shown in FIG. 1, further, a peeling finger 53 is installed above the surface of the transfer drum 23 so as to contact the latter at predetermined timing. There is also installed a press member 54 in the transfer drum 23 to facilitate the peeling of the transfer material 24 by pressing the transfer material 24 from inside at predetermined timing radially and outwardly to deform the transfer material 24. Further, a peeling corotron 47 for removing the charge of the transfer material 24 to facilitate the peeling of the transfer material 24 is installed on the upstream side of the peeling finger 53 of the transfer drum 23. The peeling finger 53 is formed of elastic material, for example, polycarbonate as engineering plastics, hard rubber and the like or otherwise made of metal. Further, the peeling finger 53 is, as shown in FIG. 3, formed like a wide wedge in cross section and has a flat upper edge face 53*a*. Further, the leading end portion 53*b* of the peeling finger 53 is, as shown in FIG. 4, linearly formed in the axial direction of the transfer drum 23, and the side end portions 53*c* of the surface of peeling finger 53 to be in contact with the transfer material are set so that they become wider in a tapered shape in the direction in which the transfer material 24 is moved forward after being peeled off the surface thereof. The leading end portion 53*b* of the peeling finger 53 is made to contact the surface of the transfer drum 23 by a width of 6 mm, for example. As shown in FIG. 5, moreover, the peeling finger 53 is installed at the same position as the detecting positions of the first, second and third jam sensors axially along the transfer drum 23.

Figure 6:
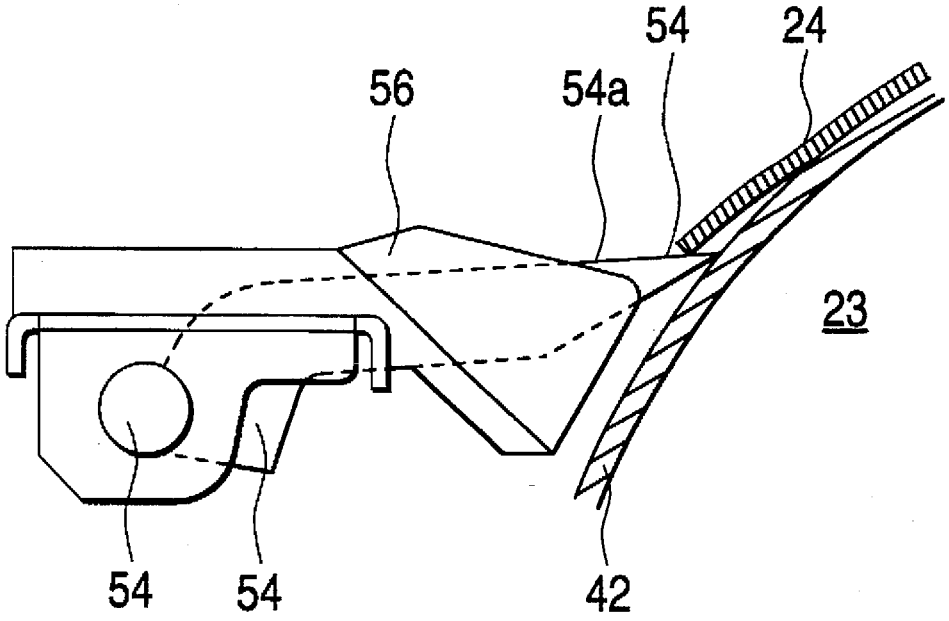
FIG. 6 is a sectional block view showing the leading end portion of the peeling finger.
Figure 7:
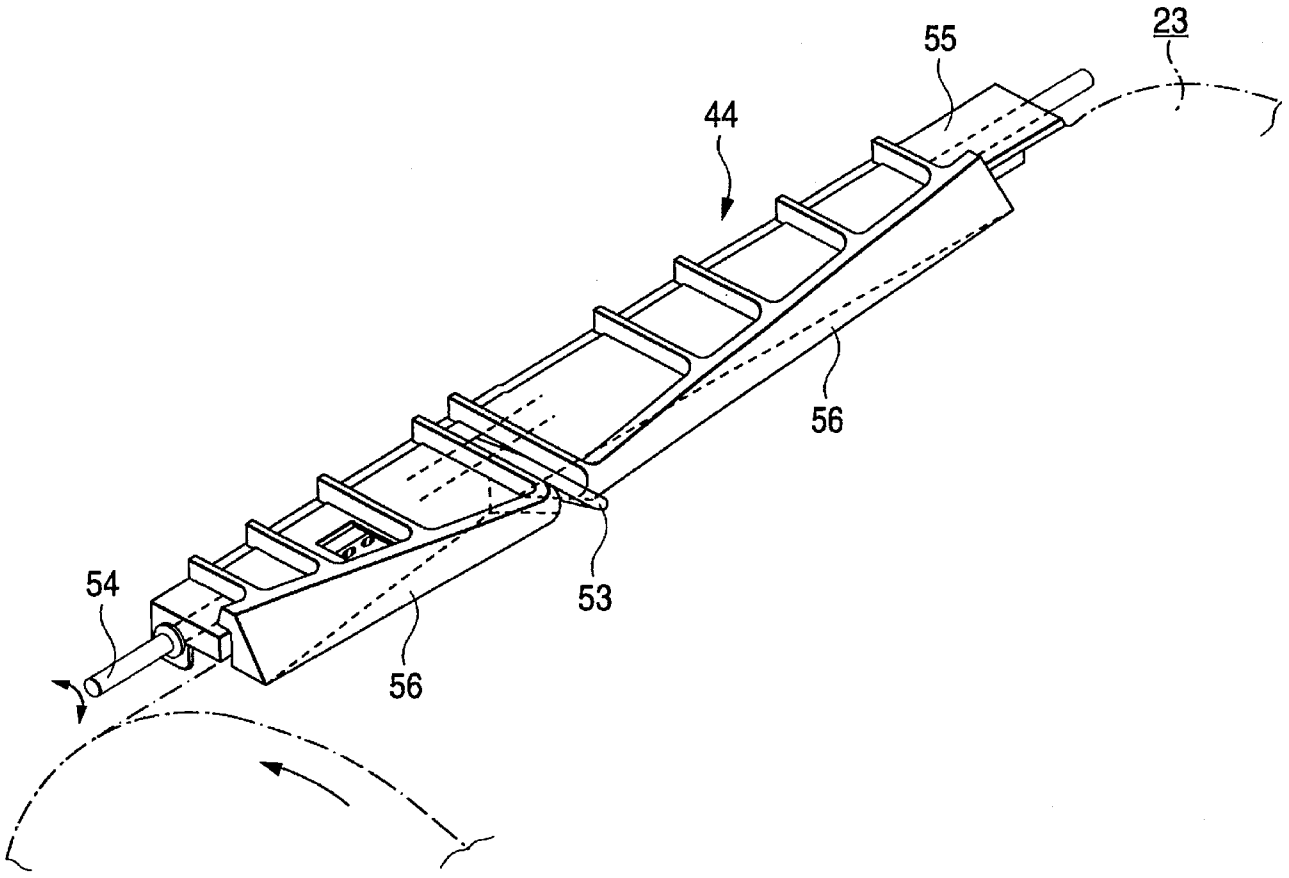
FIG. 7 is a perspective view showing the peeling finger.

The base 53*e* of the peeling finger 53 thus configured is, as shown in FIG. 6, secured to a rotary shaft 54 which is journaled onto the front and rear frames of the apparatus and when the rotary shaft 54 is rotated at predetermined timing, the leading end portion 53*b* of the peeling finger 53 is caused to abut against the surface of the transfer drum 23. As shown in FIG. 7, further, peeling guide members 56 secured to a support body 55 are each disposed on both sides of the peeling finger 53.

As shown in FIG. 1, further, a cleaning unit 57 for cleaning the surface of the transfer film 42 is installed on the outer periphery of the transfer drum 23. The cleaning unit 57 is provided with a cleaning brush 58 whose sliding surface side turns at a predetermined number of revolutions in the direction opposite to the direction in which the transfer drum 23 rotates, so that the surface of the transfer film 42 is cleaned by the cleaning brush 58. Incidentally, the direction of revolution of the cleaning brush 58 may be set equal to the direction in which the transfer drum 23 rotates. In this case, the proper width of the nip between the cleaning brush 51 and the transfer film 42 may be not less than 1 mm.

In the image forming apparatus according to this embodiment of the invention, it is arranged to simply prevent the nonconformity detection means from making any detection error in that the transfer material is conveyed in nonconforming condition in a case where the surface of the transfer drum becomes opaque and to prevent transfer film replacement intervals from being shortened.

In the image forming apparatus according to this embodiment of the invention, more specifically, toner images of black (K), yellow (Y), magenta (M) and cyan (C) successively formed on the photosensitive drum 20 as shown in FIG. 1 are successively multiple-transferred onto the transfer material 24 absorbed onto the transfer drum 23 as the transfer drum 23 rotates. Then the transfer material 24 with the toner images of such colors as prescribed is peeled by the peeling unit 44 off the surface of the transfer drum 23, and the fixing process is performed by the fixing unit 35.

In the aforesaid image forming apparatus, moreover, it is possible to make a copy on both sides of a sheet of copying paper by first turning the transfer material 24 with the toner image formed on one side upside down and then feeding the paper again from the manual-insertion tray 38. When the transfer material 23 with the plurality of toner images different in color, that is, toner images of cyan, magenta, yellow, black and the like transferred thereto is fixed by the fixing unit 35 in this image forming apparatus, a releasing agent such as silicone oil greater in quantity than what is used for a normal black and white copy is used to restrain the toner from being offset on the transfer material, and the releasing agent also sticks onto the transfer material 24. For this reason, the surface of the transfer material 24 on which the toner image has been formed may touch that of the transfer drum 23 particularly when both-side printing is made in the case of an image forming apparatus of the sort mentioned above and this may cause the releasing agent sticking onto the transfer material 24 to stick to the surface of the transfer drum 23. Then the releasing agent sticking to the surface of the transfer drum 23 acts as an adhesive and this allows floating toner and the extraneous additive of the toner or otherwise paper powder originating from transfer paper as the transfer material 24, for example, to stick onto the surface of the transfer drum 23. Like this, the floating toner and the extraneous additive of the toner or otherwise transfer paper powder produced from the transfer material 24, particularly the extraneous additive of the toner and the paper powder having a small particle size are impossible to remove completely by the cleaning brush and as they gradually accumulate on the surface of the transfer drum 23, thus making the surface of the transfer drum 23 become opaque.

According to this embodiment of the invention, however, the peeling finger 53 is located at the same position as those of the first, second and third jam sensors 50, 51, 52 axially along the transfer drum 23 as shown in FIGS. 1 and 5. Even when the floating toner and the extraneous additive of the toner or otherwise the transfer paper powder are seen to stick to the surface of the transfer drum 23, the floating toner and the extraneous additive or the transfer paper powder can properly be scraped off by the peeling finger 53, so that the surface of the transfer drum 23 is restrained from becoming opaque. Even when the surface of the transfer drum 23 becomes opaque, the first, second and third jam sensors 50, 51, 52 for detecting the transfer material 24 held on the surface of the transfer drum 23 are prevented from making any detection error, and this makes it possible to improve equipment reliability since the transfer film replacement intervals are prevented from being shortened.

This embodiment of the invention is provided with the first, second and third jam sensors 50, 51, 52 for detecting the transfer material 24 conveyed to the transfer drum 23 in nonconforming condition, and the peeling finger 53 for peeling the transfer material 24 off the transfer drum 23 by contacting the surface of the transfer drum 23 while the peeling finger 53 is so positioned as to at least linearly and axially make contact with the surface of the transfer drum 23 at the same position as those of the first, second and third jam sensors 50, 51, 52. Therefore, the extraneous additive of the toner and very small particles of such as paper powder sticking to the surface of the transfer drum 23 are scraped off by the peeling finger 53 in linear contact with the surface of the transfer drum 23, whereby the surface of the transfer drum 23 can be restrained from becoming opaque by the extraneous additive of the toner and the paper powder without the supplement of any other new member. Consequently, the first, second and third jam sensors 50, 51, 52 can be prevented from making any detection error.

Embodiment 2

Figure 10:
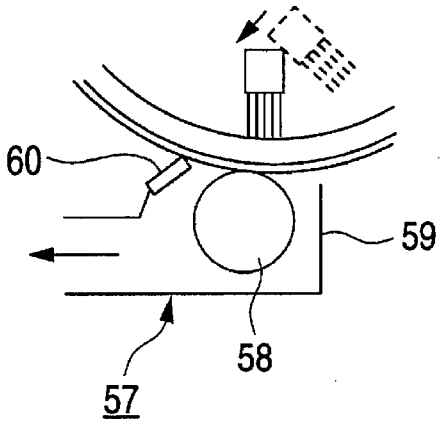
FIG. 10 is a block diagram of the principal part of an image forming apparatus as a second embodiment of the invention.

FIG. 10 shows a second embodiment of the present invention, wherein like reference characters designate like component parts in the aforesaid embodiments of the invention, and the description thereof will be given accordingly. This embodiment of the invention comprises a nonconformity detection means for detecting the transfer material conveyed to the transfer material carrier in nonconforming condition, and a blade-like cleaning means for cleaning the surface of the transfer material carrier, the blade-like cleaning means therefor being located in the same position as that of the means for detecting the transfer material carrier conveyed axially in nonconforming condition.

More specifically, according to this embodiment of the invention, the cleaning unit 57 is provided with a housing 59 for housing the cleaning brush 58 as shown in FIG. 10 and the leading end portion of the housing 59 is opened so that the cleaning brush 58 is allowed to contact the transfer drum 23, whereas the base portion thereof is connected to a suction means (not shown). Further, the housing 59 of the cleaning unit 57 is fitted with a cleaning blade 60 at the same position as those of the first, second and third jam sensors 50, 51, 52 in the axial direction of the transfer drum. Further, the cleaning blade 60 is formed so that it linearly or facially contacts the surface of the transfer drum 23 with substantially the same width as the detection width of the jam sensors 50, 51, 52.

Figure 11:
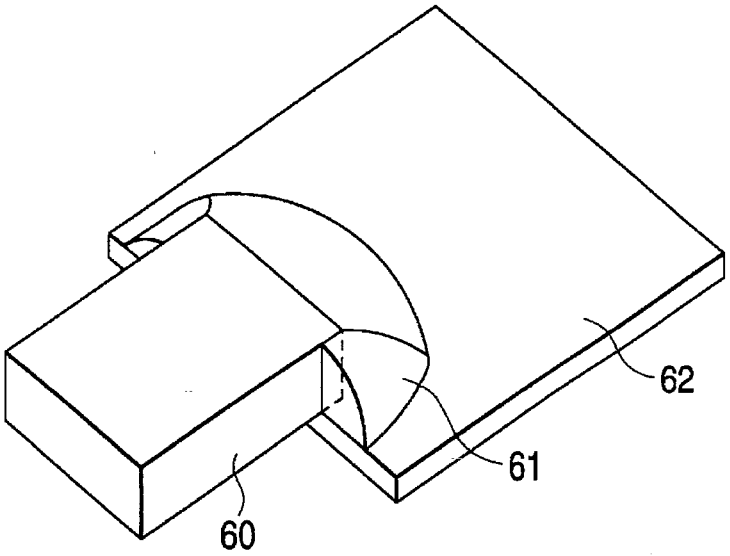
FIG. 11 is a perspective view showing the cleaning blade.

As the cleaning blade 60, a plastic blade of silicone rubber, polyethylene terephthalate or the like is employed as shown in FIG. 11. The cleaning blade 60 is rigidly secured to a board 62 with an adhesive 61 or the like and installed in the so-called wiper direction along the direction of rotation of the transfer drum 23 via the board 62, for example. In this case, the cleaning blade 60 may be in such a form that part of the housing 59 of the cleaning unit 57 is shaped into a blade or otherwise may be placed in the so-called doctor direction opposite to the direction of rotation of the transfer drum 23.

Figure 12:
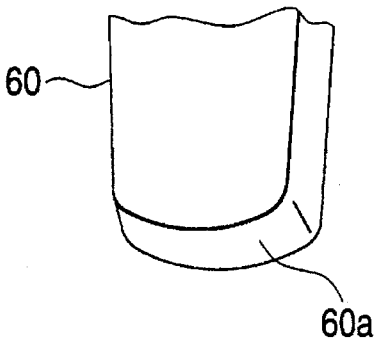
FIG. 12 is a perspective view showing a modified example of the cleaning blade.

As shown in FIG. 12, further, the leading end portion **62*a* of the aforementioned cleaning blade 60 may be curved, whereby it can contact the surface of the transfer drum 23** uniformly in the width direction therefor.

This embodiment of the invention is provided with the first, second and third jam sensors 50, 51, 52 for detecting the transfer material 24 conveyed to the transfer drum 23 in nonconforming condition, and the cleaning blade 60 for cleaning the surface of the transfer drum 23. Since the cleaning blade 60 is located at the same position as the detecting positions of the jam sensors 50, 51, 52 in the axial direction of the transfer drum 23, the surface of the transfer drum 23 is restrained from becoming opaque with such a simple arrangement that the cleaning blade 60 is located at the same position as the detecting positions of the jam sensors 50, 51, 52 in the axial direction of the transfer drum 23. Thus the jam sensors 50, 51, 52 can be prevented from making any detection error.

As the constitution and functions other than those described in reference to the embodiment above, the description thereof will be omitted.

Embodiment 3

Figure 13A:
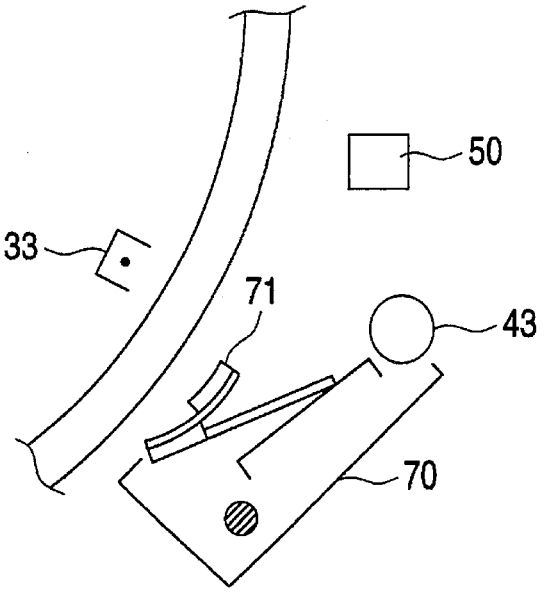
FIGS. 13A and 13B are block diagrams of the principal parts of an image forming apparatus as a third embodiment of the invention.
Figure 13B:
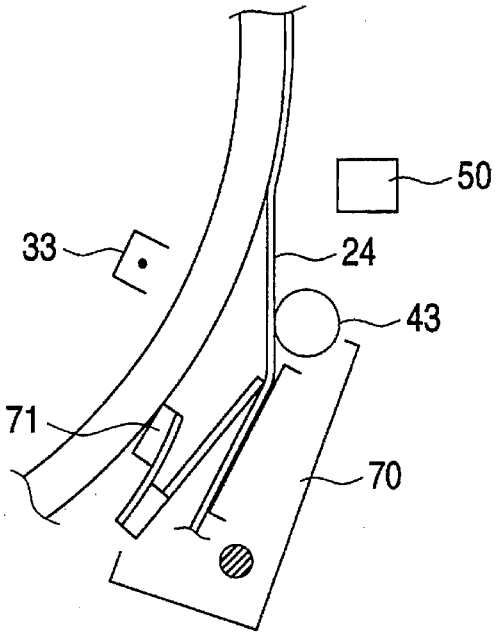
Figure 14:
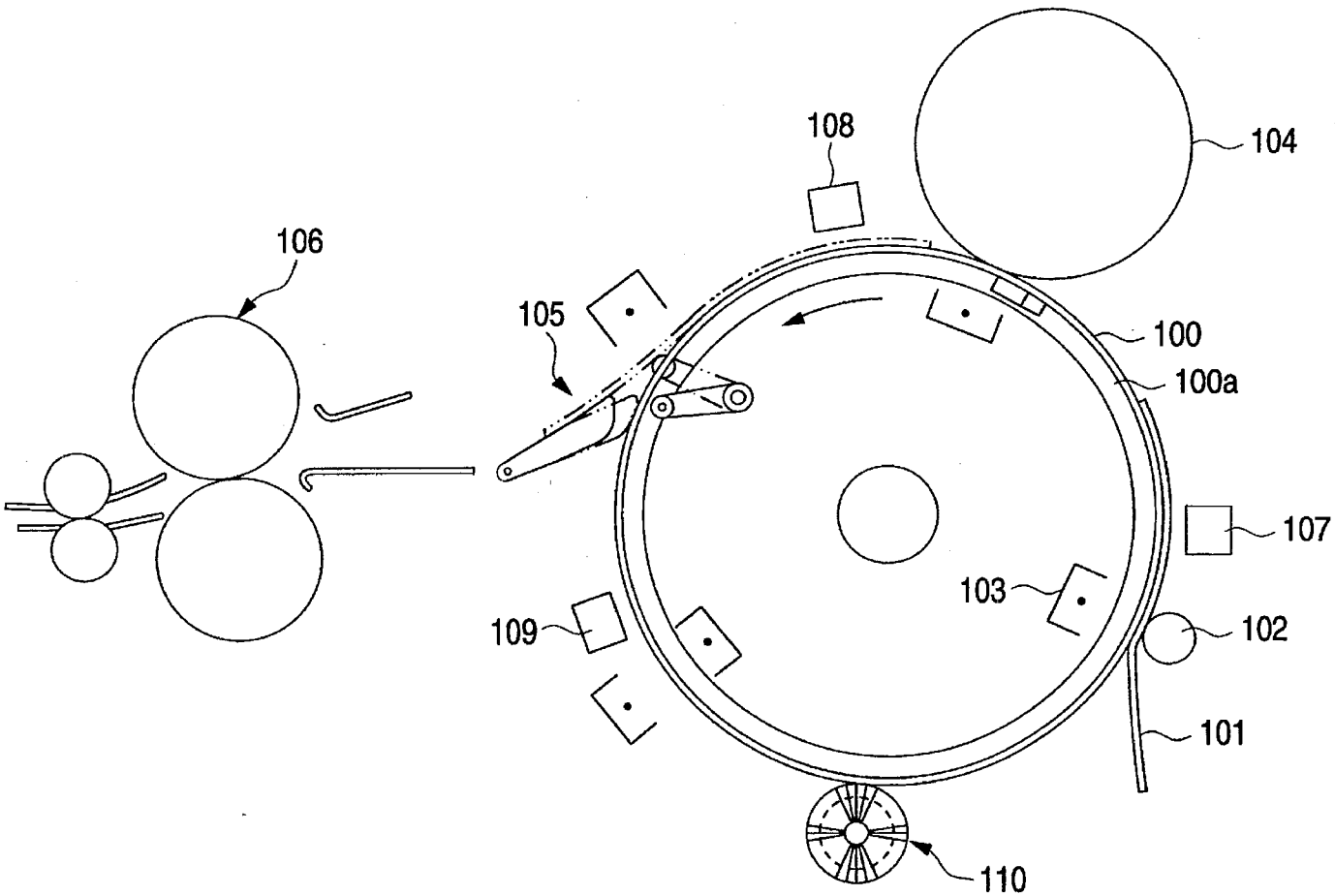
FIG. 14 is a block diagram of an image-forming section of a conventional image forming apparatus.

FIG. 13 shows a third embodiment of the present invention, wherein like reference characters designate like component parts in the aforesaid embodiments of the invention, and the description thereof will be given accordingly. This embodiment of the invention is provided with the nonconformity detection means for detecting the transfer material conveyed to the transfer material carrier in nonconforming condition, and the blade-like cleaning means for cleaning the surface of the transfer material carrier, the blade-like cleaning means therefor being located in the same position as that of the means for detecting the transfer material carrier conveyed axially in nonconforming condition.

More specifically, according to this embodiment of the invention, the paper absorption roll 43 for absorbing the transfer material 24 to the surface of the transfer drum 23 is, as shown in FIG. 13, provided with a housing 70, which is fitted with a cleaning blade 71 that makes contact with the surface of the transfer drum 23 from the direction opposite to the direction in which the transfer drum 23 rotates simultaneously when the absorption roll 43 contacts the surface of the transfer drum 23. Further, the housing 70 may be fitted with part of support Mylar in the form of a blade or a blade itself for guiding the bracket of the paper absorption roll 43 and the transfer material.

Since the remaining constitution and function are similar to those in the aforesaid embodiments of the invention, the description thereof will be omitted.

Although there are employed the cleaning unit and the paper absorption roll as members for fitting the cleaning blade which are attached to and detached from the surface of the transfer drum 23 originally provided for the image forming apparatus, a new additional mechanism capable of contacting and separating from the surface of the transfer drum 23 may needless to say be provided.

Embodiment 4

Figure 15:
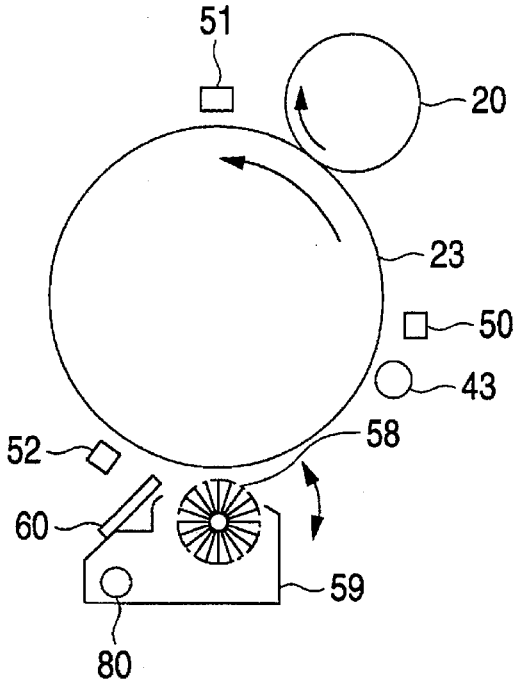
FIG. 15 is a block diagram of the principal part of an image forming apparatus as a fourth embodiment of the invention.

FIG. 15 shows a fourth embodiment of the present invention, wherein like reference characters designate like component parts in the aforesaid embodiments of the invention, and the description thereof will be given accordingly. This embodiment of the invention comprises the transfer material detecting means for detecting conditions in which the transfer material is conveyed on the transfer material carrier or the concentration detecting means for detecting toner concentration on the transfer material carrier, and the cleaning means for cleaning the transfer material carrier installed at least at the same position as that of the transfer material detecting means or the concentration detecting means in the axial direction of the transfer material carrier. The axial length of the cleaning means is set greater than the diameter of the beam spot of the detecting means above and smaller than the effective image width, and the cleaning means is capable of contacting and separating from the transfer material carrier.

Figure 16:
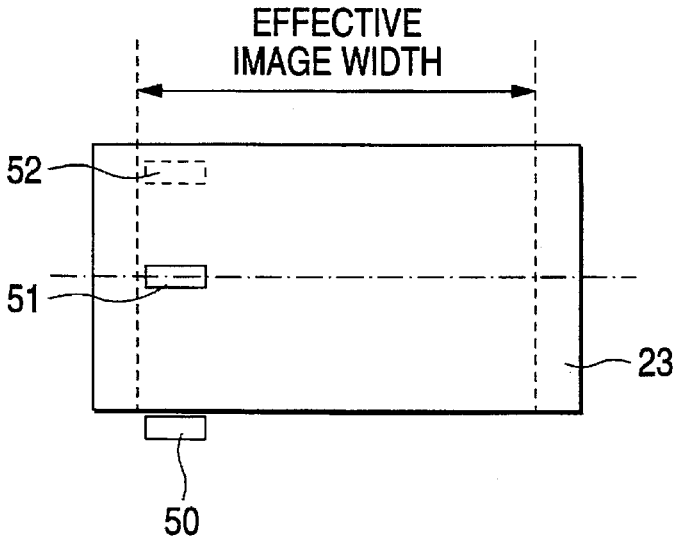
FIG. 16 is a block diagram illustrating an arrangement of sensors.

More specifically, according to this embodiment of the invention, as shown in FIG. 15, a pre-absorption sensor 50 for detecting whether the transfer material 24 has been absorbed onto the surface of the transfer drum 23 is installed at a position corresponding to the downstream side of the absorption roll 43; a post-transfer sensor 51 for detecting whether the transfer material 24 has been held on the surface of the transfer drum 23 without being moved toward the photosensitive drum 20 is installed on the downstream side of the nip portion of the photosensitive drum 20; and a pre-cleaning sensor 52 for detecting whether the transfer material 24 has been peeled off the surface of the transfer drum 23. These pre-absorption, post-transfer and pre-cleaning sensors 50, 51, 52 are adapted for use in optically detecting whether the transfer material 24 has been held on the surface of the transfer drum 23 by emitting a spot beam about 3 mm in diameter to the surface of the transfer drum 23 so as to detect diffuse reflection light, regular reflection light and the like from the surface side of the transfer drum 23. Further, the pre-absorption, post-transfer and pre-cleaning sensors 50, 51, 52 are all disposed at the same position in the axial direction of the transfer drum 23 and in the vicinity of one end portion of the effective image width as shown in FIG. 16.

According to this embodiment of the invention, moreover, the first cleaning unit 57 is provided with the housing 59 for housing the cleaning brush 58 as shown in FIG. 15 and the leading end portion of the housing 59 is opened so that the cleaning brush 58 is allowed to contact the transfer drum 23. Further, the housing 59 is capable of rocking around a fulcrum 80 in the direction in which the cleaning brush 58 contacts and separates from the transfer drum 23. Further, the housing 59 of the cleaning unit 57 is fitted with the cleaning blade 60 as a second cleaning means at the same position as those of the pre-absorption, post-transfer and pre-cleaning sensors 50, 51, 52 in the axial direction of the transfer drum. The cleaning blade 60 is also capable of contacting and separating from the surface of the transfer drum 23 in the mode interlocked with the housing of the cleaning unit 57. Moreover, the cleaning blade 60 is installed on the upstream side of the cleaning brush 58. Further, the axial length of the cleaning blade 60 is set greater than the diameters of the beam spots of the sensors 50, 51, 52 above and smaller than the effective image width, and the cleaning blade 60 is installed so that it linearly or facially contact the surface of the transfer drum 23. In this case, a support member facing the cleaning blade 60 may be provided in proportion to the axial length of the cleaning blade 60 on the inner face side of the transfer drum 23: in such a case as this, the transfer film 42 can be prevented from being deformed even though the axial length of the cleaning blade 60 is greater to a certain degree to ensure that the surface of the transfer film 42 is cleaned over a predetermined length.

Figure 17:
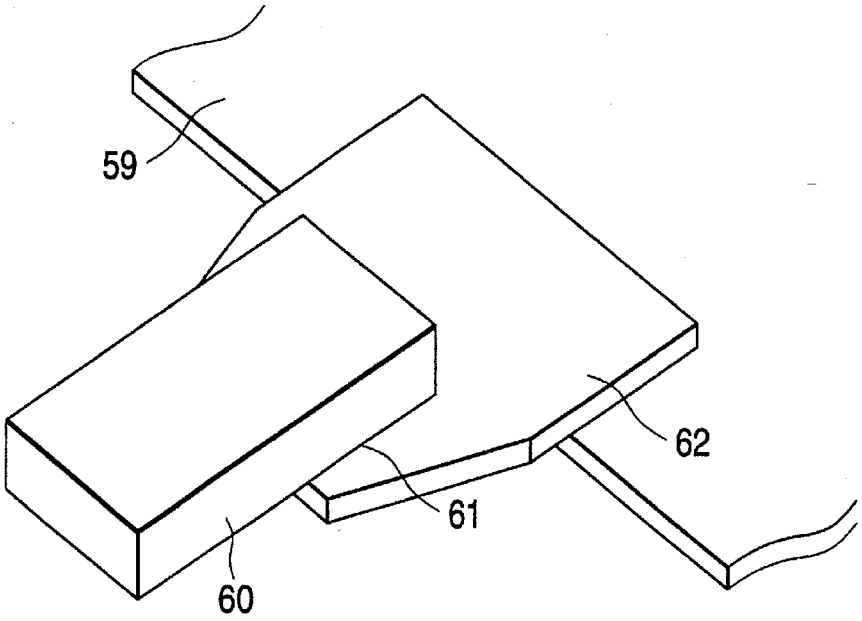
FIG. 17 is a perspective view of the cleaning blade.

As the cleaning blade 60, a plastic blade of silicone rubber, polyethylene terephthalate or the like is employed as shown in FIG. 17. The cleaning blade 60 is rigidly secured to a metal plate 62 forming the housing 59 of the cleaning unit 57 or the metal plate 62 fitted to the housing 59 with an adhesive 61 and installed in the so-called wiper direction along the direction of rotation of the transfer drum 23 via the metal plate 62, for example. In this case, the cleaning blade 60 may be in such a form that part of the housing 59 of the cleaning unit 57 is shaped into a blade or otherwise may be placed in the so-called doctor direction opposite to the direction of rotation of the transfer drum 23.

Although the cleaning blade 60 is normally made to contact the surface of the transfer drum 23 under a contact pressure of approximately 50 gf to 500 gf, about 200 gf, for example, is exerted in this case.

Subsequently, the present inventors made tests under such a condition that opposed members for holding the transfer film 42 of the transfer drum 23 therebetween were absent as shown in FIG. 15. Tests were made to confirm how cleaning efficiency on the surface of the transfer drum 23 varied when the axial length of the cleaning blade 60 was changed. Incidentally, a beam spot having a diameter of 3 mm was employed for the sensor 50.

FIG. 18 shows the test results.

As is clearly shown in FIG. 18, the cleaning efficiency was 100% when the cleaning blade 60 was not less than 4 mm long and the cleaning efficiency was not less than 90% though it slightly lowered when the cleaning blade 60 became 20 mm long. In other words, it was found satisfactory that the cleaning blade 60 was not less than 4 mm and not greater than 20 mm.

This embodiment of the invention is thus provided with the sensors 50, 51, 52 for detection the conditions in which the transfer material 24 is conveyed on the transfer drum 23, and the cleaning blade 60 for cleaning the surface of the transfer drum 23, the cleaning blade 60 being located at the same position as those of detecting positions of the sensors 50, 51, 52 in the axial direction of the transfer drum 23, whereby it is possible to prevent not only the surface of the transfer drum 23 from becoming opaque but also the sensors 50, 51, 52 from making any detection error simply by arranging the cleaning blade 60 at the same position as those of the jam sensors 50, 51, 52 in the axial direction of the transfer drum 23.

Since the axial length of the cleaning blade 60 is set greater than the diameters of the beam spots of the sensors 50, 51, 52 above and smaller than the effective image width, the length equivalent to the diameters of the beam spots of the sensors 50, 51, 52 can be cleaned without fail. Since the axial length of the cleaning blade 60 is set smaller than the effective image width, moreover, the areas equivalent to those of the sensors 50, 51, 52 can effectively be cleaned. Further, the cleaning means is capable of rocking with respect the transfer material carrier, whereby no damage is caused to the toner image transferred onto the transfer material.

Since the cleaning blade 60 together with the cleaning brush 58 contacts and separates from the transfer drum 23, the cleaning blade 60 is prevented from causing any trouble to the transfer material 24 without using any special member.

The axial length of the cleaning blade 60 is set greater than the diameters of the beam spots of the sensors 50, 51, 52, namely, not greater then 20 mm, to ensure that at least the length equivalent to the diameters of the beam spots of the sensors 50, 51, 52 is cleaned. As is obvious from the tests made by the present inventors, the cleaning efficiency is prevented from lowering in a case where the length exceeds 20 mm.

Further, the cleaning blade 60 is installed on the upstream side of the cleaning brush 58, so that the toner and the extraneous additive of the toner scraped off by the cleaning blade 60 and the paper powder can be removed by the cleaning brush 58.

Since the remaining constitution and function are similar to those in the aforesaid embodiments of the invention, the description thereof will be omitted.

Embodiment 5

Figure 19:
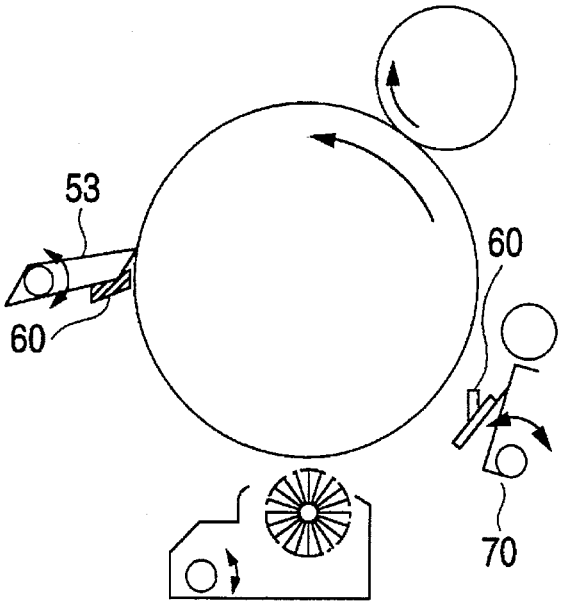
FIG. 19 is a block diagram of the principal part of an image forming apparatus as a fifth embodiment of the invention.

FIG. 19 shows a fifth embodiment of the present invention, wherein like reference characters designate like component parts in the aforesaid embodiments of the invention, and the description thereof will be given accordingly. This embodiment of the invention comprises the transfer material detecting means for detecting conditions in which the transfer material is conveyed on the transfer material carrier or the concentration detecting means for detecting toner concentration on the transfer material carrier, and the cleaning means for cleaning the transfer material carrier installed at least at the same position as that of the transfer material detecting means or the concentration detecting means in the axial direction of the transfer material carrier, the cleaning means being capable of contacting and separating from the transfer material carrier. The axial length of the cleaning means is greater than the diameter of the beam spot of the detecting means and smaller than the effective image width.

More specifically, according to this embodiment of the invention, as shown in FIG. 19, the cleaning blade 60 is fitted to at least either underside of the peeling finger 53 or housing 70 of an auxiliary transfer material absorption member, and the cleaning blade 60 together with the peeling finger 53 and the housing 70 of the auxiliary transfer material absorption member is capable of contacting and separating from the surface of the transfer drum 23.

The axial length of the cleaning blade 60 is set greater than the diameters of the beam spots of the sensors 50, 51, 52 and smaller than the effective image width and formed so that it linearly or facially contacts the surface of the transfer drum 23. Incidentally, the axial length of the cleaning blade 60 may be set greater than the diameters of the beam spots of the sensors 50, 51, 52, namely, not greater than 20 mm.

As the cleaning blade 60 is so arranged as to contact and separating from the surface of the transfer drum 23 in the mode interlocked with a member related to feeding and peeling the transfer material 24 on the transfer drum 23, it is ensured to prevent the cleaning blade 60 from causing trouble to the transfer material 24 on the transfer drum 23.

Since the remaining constitution and function are similar to those in the aforesaid embodiments of the invention, the description thereof will be omitted.

Embodiment 6

Figure 20:
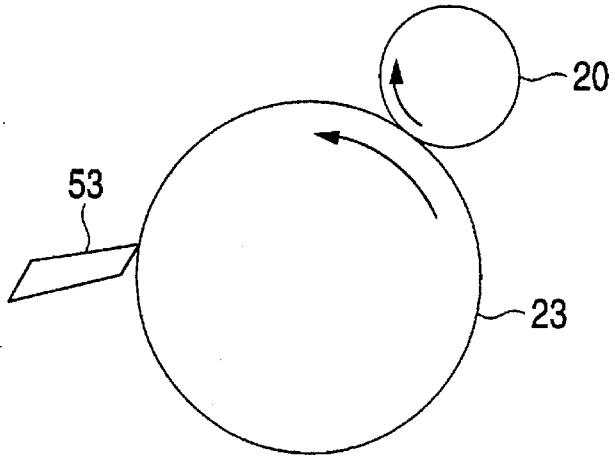
FIG. 20 is a block diagram of the principal part of an image forming apparatus as a sixth embodiment of the invention.

FIG. 20 shows a sixth embodiment of the present invention, wherein like reference characters designate like component parts in the aforesaid embodiments of the invention, and the description thereof will be given accordingly. This embodiment of the invention comprises the transfer material detecting means for detecting conditions in which the transfer material is conveyed on the transfer material carrier or the concentration detecting means for detecting toner concentration on the transfer material carrier, and a transfer material peeling means for peeling the transfer material off the transfer material carrier by contacting the surface of the transfer material carrier. The transfer material peeling means is provided so that it at least linearly contacts the axial surface of the transfer material carrier at least at the same position as that of the transfer material detecting means or the concentration detecting means in the axial direction of the transfer material carrier.

Figure 21:
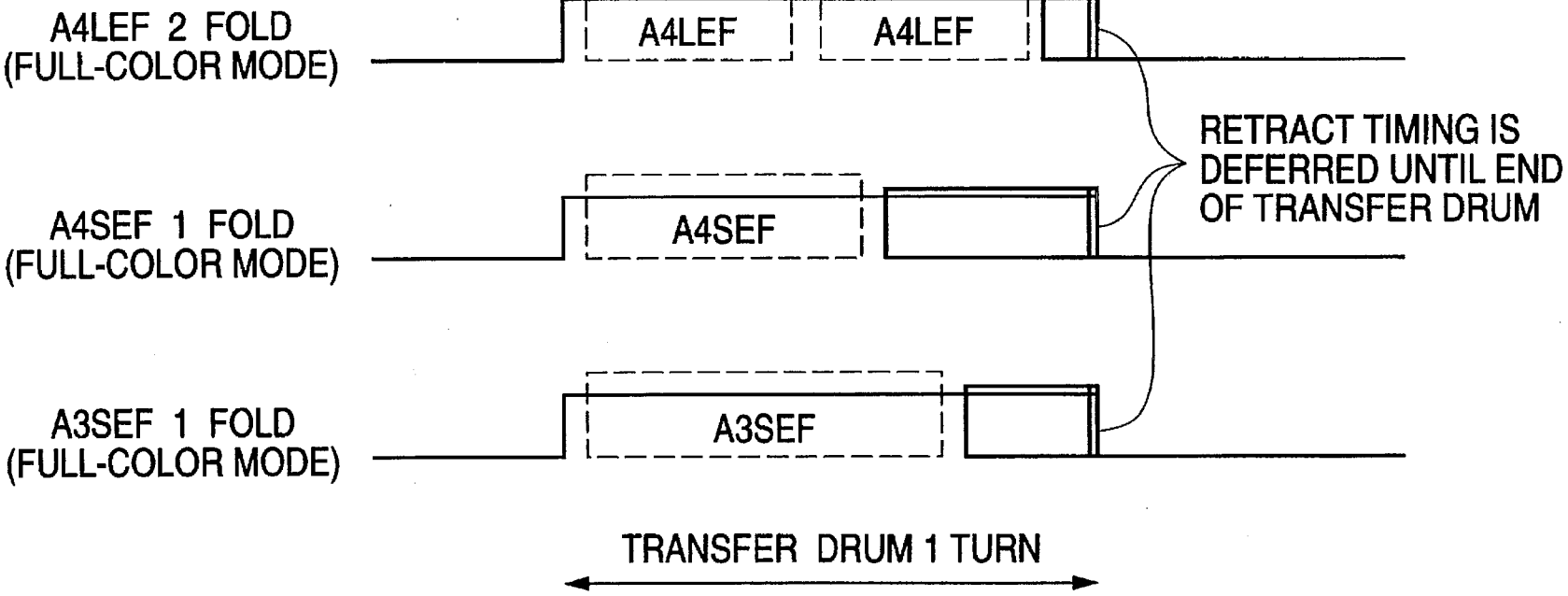
FIG. 21 is a timing chart showing the contact timing of the peeling finger.

In other words, according to this embodiment of the invention, the transfer film 42 is cleaned by the peeling finger 53 as shown in FIG. 20 and the peeling finger 53 is made to contact the whole circumferential surface of the transfer drum 23 during the peeling operation as shown in FIG. 21. When copies are continuously made in a monochromatic mode, the peeling finger 53 is kept contacting the surface of the transfer drum 23.

With the arrangement above, the whole circumference of the transfer drum 23 can be cleaned to ensure that even when the sensors 50, 51, 52 are so arranged as to examine the whole surface of the transfer drum 23 statistically, that is, regularly, the sensors 50, 51, 52 are prevented from making any detection error.

Figure 22:
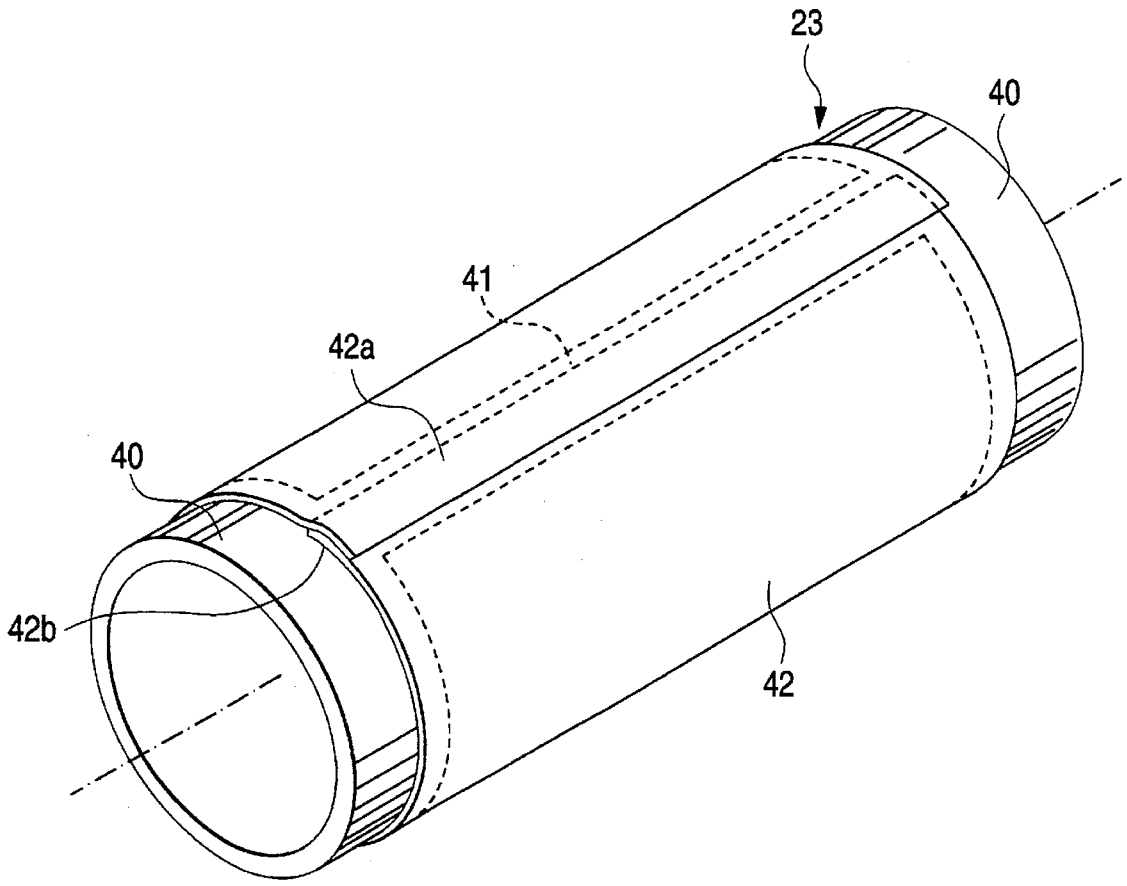
FIG. 22 is a perspective view showing another embodiment of the transfer drum of the invention.
Figure 23:
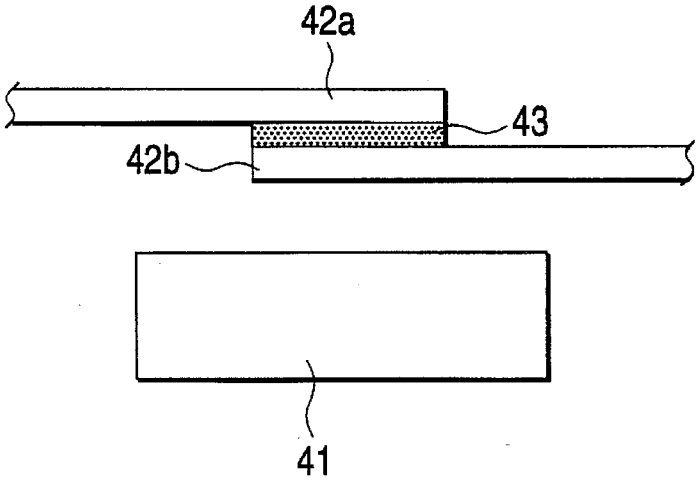
FIG. 23 is a sectional view showing the joint of the transfer drum.
Figure 24:
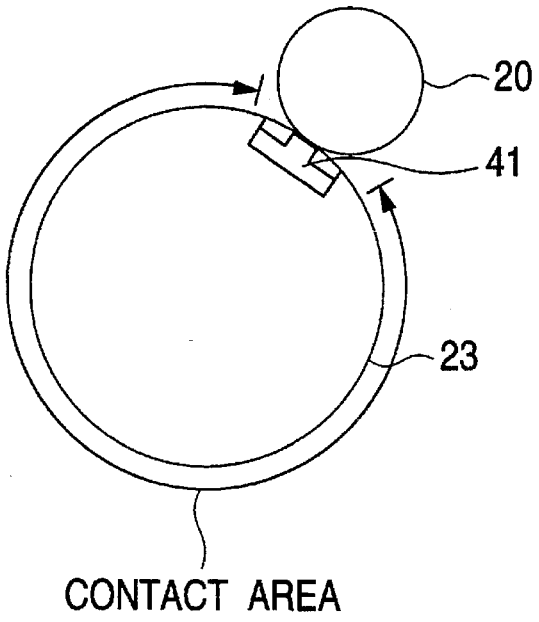
FIG. 24 is a diagram illustrating the contact timing of the peeling finger.

Further, a transfer drum shown in FIG. 22 in addition to the transfer drum 23 shown in FIG. 9 may be used and the former transfer drum 23 is, as shown in FIG. 22, provided with ring members 40, 40 as a pair of annular members each disposed axially in both end portions, and a drum-like frame body having the tie-bar plate 41 as a coupling member for coupling the ring members 40, 40 together. While both end portions of the transfer film 42 formed of a dielectric film of polyvinylidene fluoride (PVdF) or the like are each put along the outer peripheral faces of the ring members 40, 40 and wound on the frame body, they are fixed thereto with a double-coated adhesive tape. Then the circumferential front and rear end portions 42*a*, 42*a* of the transfer film 42 are mutually overlapped as shown in FIG. 23 and bonded with the double-coated adhesive tape before being formed into a hollow cylinder. The bonded portion of the transfer film 42 is placed in a non-imaging area, that is, in a position corresponding to and on the tie-bar plate 41 via a gap because the bonded portion of the transfer film 42 is not fit for the smooth transfer of the toner image formed on the photosensitive drum 20.

With both the overlapped, bonded ends of the transfer film 42 by means of the double-coated adhesive tape 43, the peeling finger is made to contact the whole circumferential surface of the transfer drum 23 during the peeling operation. The whole circumference of the transfer drum 23 can thus be cleaned, so that static detection is carried out by the sensors 50, 51, 52.

When the transfer drum 23 is employed as shown in FIG. 9, it is also acceptable to make the peeling finger 53 contact the surface of the transfer drum 23 limited to the detection area of the sensor 50 or the like for detecting the conditions in which the transfer material 24 on the transfer drum 23 is conveyed in the circumferential direction of the transfer drum 23 during the peeling operation.

Since the remaining constitution and function are similar to those in the aforesaid embodiments of the invention, the description thereof will be omitted.

Embodiment 7

Figure 25A:
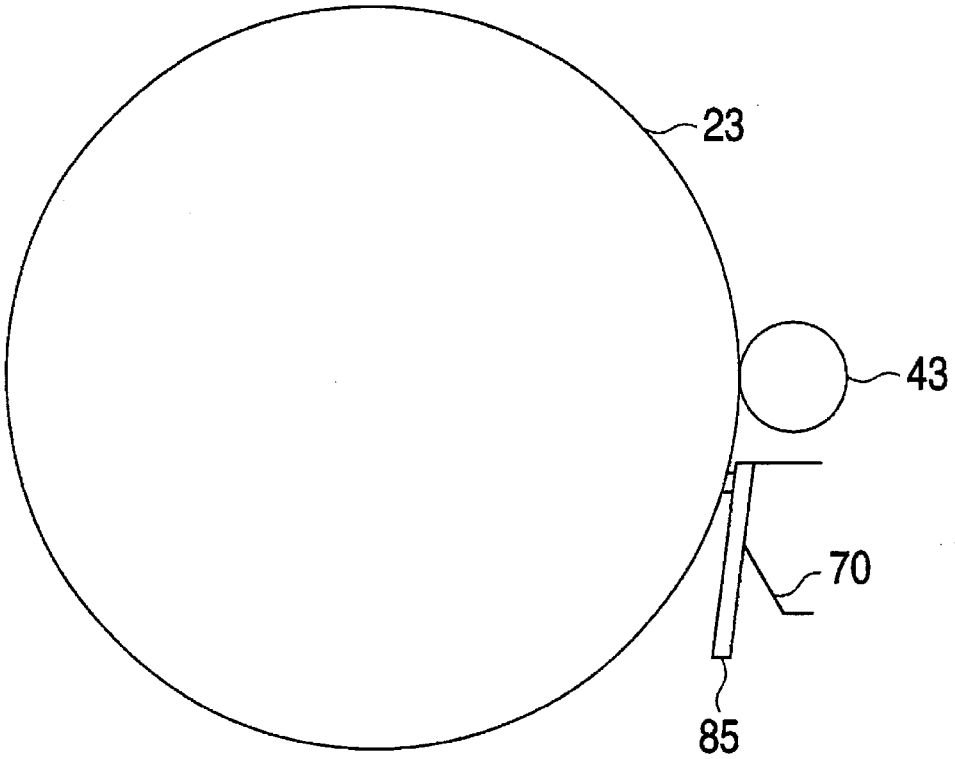
FIGS. 25A and 25B is a block diagram of the principal part of an image forming apparatus as a seventh embodiment of the invention.
Figure 25B:
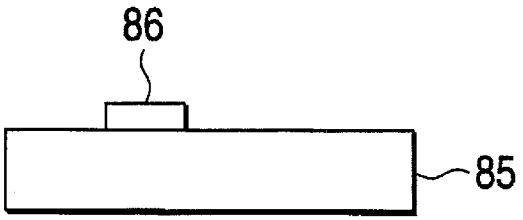

FIG. 25 shows a seventh embodiment of the present invention, wherein like reference characters designate like component parts in the aforesaid embodiments of the invention, and the description thereof will be given accordingly. This embodiment of the invention comprises the transfer material detecting means for detecting conditions in which the transfer material is conveyed on the transfer material carrier or the concentration detecting means for detecting toner concentration on the transfer material carrier, and the auxiliary transfer material absorption member for absorbing the transfer material onto the surface of the transfer material carrier. The auxiliary transfer material absorption member is axially disposed so as to at least linearly contact the surface of the transfer material carrier at least at the same position as that of the transfer material detecting means or the concentration detecting means in the axial direction of the transfer material carrier.

Figure 26:
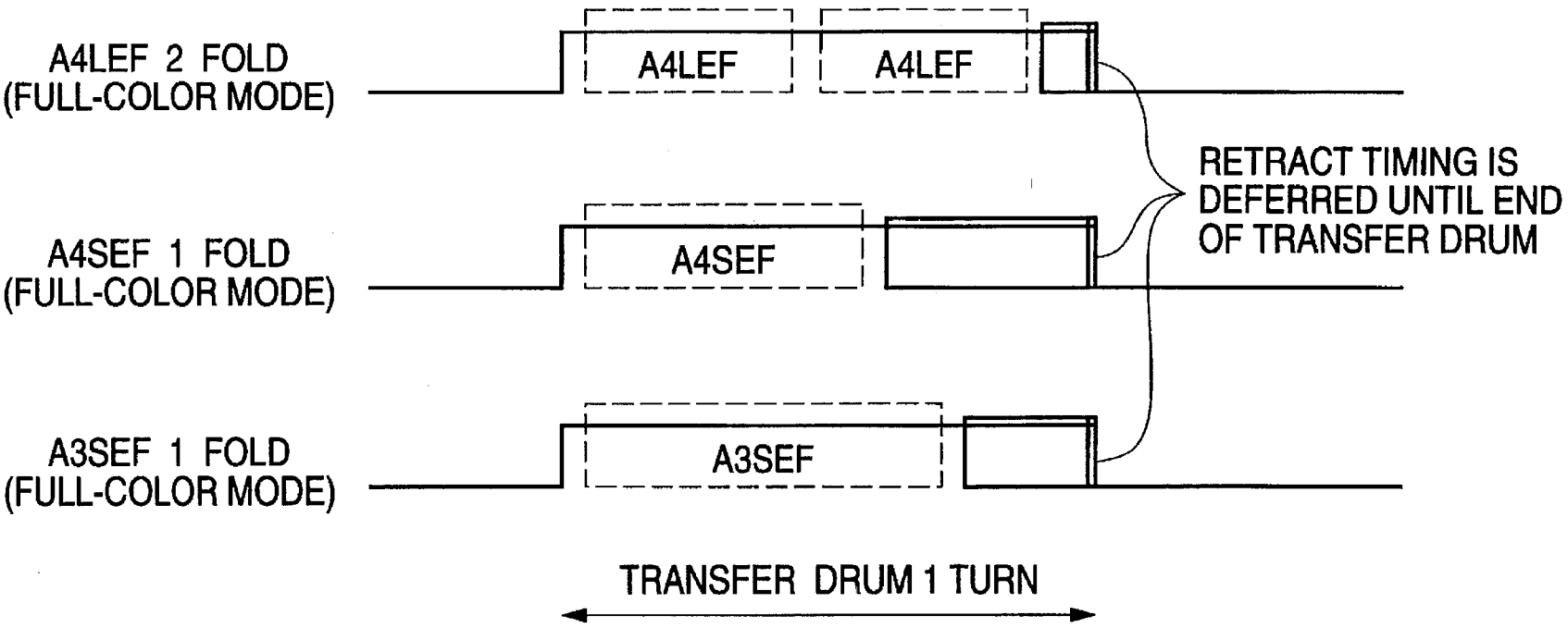
FIG. 26 is a timing chart showing the contact timing of an auxiliary absorption member.

More specifically, according to this embodiment of the invention, there is provided a protrusion 86 in the leading end portion of the support Mylar 85 of a auxiliary transfer material absorption member 70 as shown in FIG. 25 and when the protrusion 86 of the support Mylar 85 of the auxiliary transfer material absorption member 70 contacts the surface of the transfer drum 23 at the timing shown in FIG. 26 during the absorption of the transfer material, the surface of the transfer drum 23 is cleaned. When copies are continuously made in the monochromatic mode, the peeling finger 53 is kept contacting the surface of the transfer drum 23.

Since the remaining constitution and function are similar to those in the aforesaid embodiments of the invention, the description thereof will be omitted.

Embodiment 8

Figure 27:
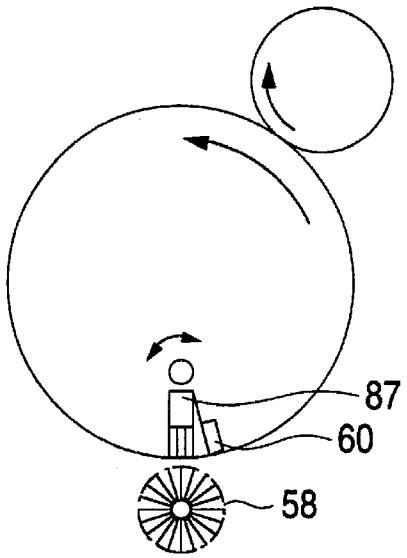
FIG. 27 is a block diagram of the principal part of an image forming apparatus as an eighth embodiment of the invention.

FIG. 27 shows an eighth embodiment of the present invention, wherein like reference characters designate like component parts in the aforesaid embodiments of the invention, and the description thereof will be given accordingly. The aforesaid cleaning means is provided for a first inside cleaning means for cleaning the transfer material carrier according to this embodiment of the invention.

More specifically, according to this embodiment of the invention, the cleaning blade 60 is fitted to an inside cleaning brush 87 provided inside the transfer drum 23 in such a way as to face the cleaning brush. The cleaning blade 60 together with the inside cleaning brush 87 turns round the fulcrum so as to contact the inner face of the transfer drum 23 at predetermined timing. The cleaning blade 60 may be placed on the upstream side of the inside cleaning brush 87.

Since the remaining constitution and function are similar to those in the aforesaid embodiments of the invention, the description thereof will be omitted.

Embodiment 9

Figure 28A:
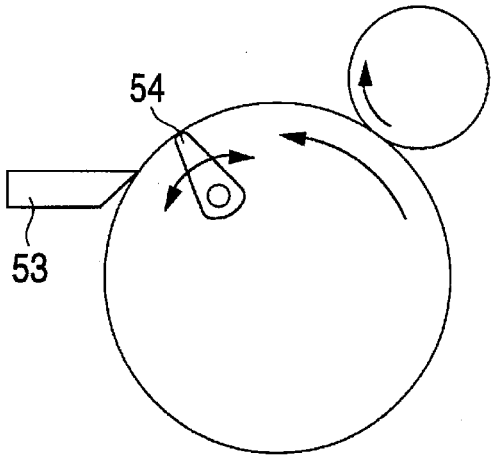
FIGS. 28A and 28B is a block diagram of the principal part of an image forming apparatus as a ninth embodiment of the invention.
Figure 28B:
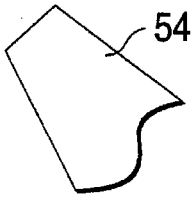

FIG. 28 shows a ninth embodiment of the present invention, wherein like reference characters designate like component parts in the aforesaid embodiments of the invention, and the description thereof will be given accordingly. This embodiment of the invention comprises the transfer material detecting means for detecting conditions in which the transfer material is conveyed on the transfer material carrier or the concentration detecting means for detecting toner concentration on the transfer material carrier, and an inside peeling means for peeling the transfer material off the transfer material carrier by contacting the inner face of the transfer material carrier. The inside peeling means is axially disposed so as to at least linearly contact the surface of the transfer material carrier at least at the same position as that of the transfer material detecting means or the concentration detecting means in the axial direction of the transfer material carrier.

More specifically, according to this embodiment of the invention, the press member 54 as the inside peeling means is installed inside the transfer drum 23 as shown in FIG. 28 and made to contact the inner face of the transfer drum 23 axially and linearly at the same position as those of the sensors 50, 51, 52. Therefore, the leading end portion of the press ember 54 as the inside peeling means is edge-shaped as shown in FIG. 28(*b*).

Since the remaining constitution and function are similar to those in the aforesaid embodiments of the invention, the description thereof will be omitted.

Embodiment 10

Figure 29:
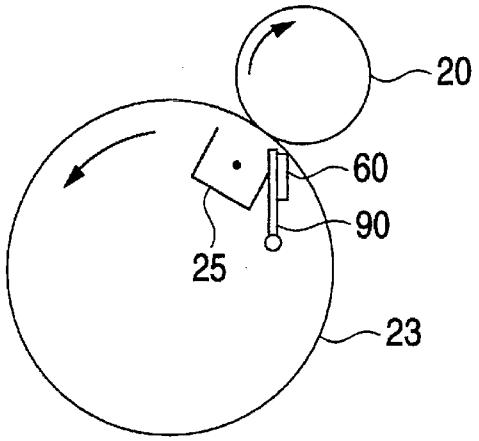
FIG. 29 is a block diagram of the principal part of an image forming apparatus as a tenth embodiment of the invention.

FIG. 29 shows a tenth embodiment of the present invention, wherein like reference characters designate like component parts in the aforesaid embodiments of the invention, and the description thereof will be given accordingly. The aforesaid cleaning means is provided for an auxiliary transfer member and used for cleaning the inner face of the transfer material carrier during the transfer operation.

More specifically, according to this embodiment of the invention, the transfer corotron 25 disposed at the transfer position inside the transfer drum is provided with a transfer guide 90 of such as a Mylar film for concentrating a transfer electric field onto the transfer position, and the cleaning blade 60 is fitted to the transfer guide 90. The transfer guide 90 is so arranged as to contact and separate from the inner face of the transfer drum 23 at predetermined timing.

Since the remaining constitution and function are similar to those in the aforesaid embodiments of the invention, the description thereof will be omitted.

Embodiment 11

Figure 30:
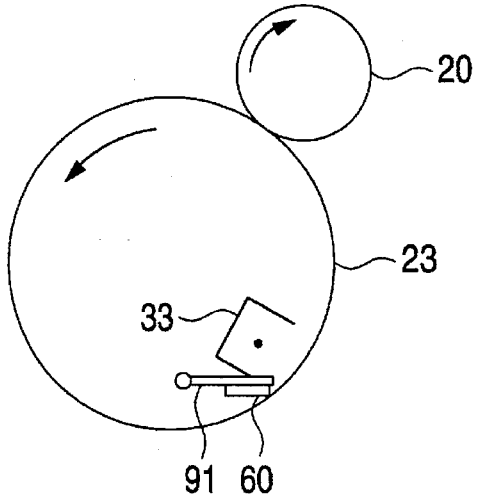
FIG. 30 is a block diagram of the principal part of an image forming apparatus as an eleventh embodiment of the invention.

FIG. 30 shows an eleventh embodiment of the present invention, wherein like reference characters designate like component parts in the aforesaid embodiments of the invention, and the description thereof will be given accordingly. The aforesaid cleaning means is provided for the auxiliary transfer material absorption member.

More specifically, according to this embodiment of the invention, the absorption corotron 33 disposed at the transfer material absorption position inside the transfer drum 23 is provided with an absorption guide 91 of such as a Mylar film for concentrating a transfer electric field onto the absorption position, and the cleaning blade 60 is fitted to the absorption guide 91. The absorption guide 91 may be so arranged as to contact and separate from the inner face of the transfer drum 23 at predetermined timing or to contact the inner face thereof regularly.

Since the remaining constitution and function are similar to those in the aforesaid embodiments of the invention, the description thereof will be omitted.

Figure 31:
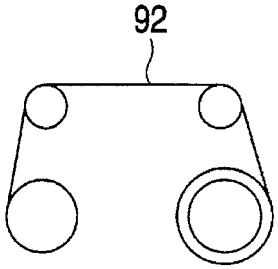
FIG. 31 is a block diagram showing another embodiment of the cleaning means of the invention.
Figure 32:
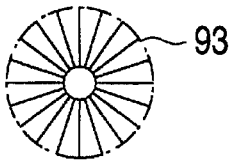
FIG. 32 is a block diagram showing still another embodiment of the cleaning means of the invention.

Although a description has been given of a case where the cleaning means is formed with the blade as shown in FIG. 11 in the aforesaid embodiments of the invention, use can be made of web cleaning 92 of FIG. 31 and brush cleaning 93 of FIG. 32 as the cleaning means. Even in these cases, however, the width of the web and brush is set greater than the diameter of the beam spot of the sensor.

Although a description has been given of a case where a single cleaning means is provided axially along the transfer drum, moreover, a plurality of cleaning means may be provided axially along the transfer drum, if necessary.

According to the image forming apparatus of the invention comprises a detecting means for optically detecting a condition of an outer surface of the transfer material carrier by use of a beam spot light; and first cleaning means for cleaning the transfer material carrier installed at the same position as position of the detecting means in the axial direction of the transfer material carrier, an axial length of the first cleaning means being greater than a diameter of the beam spot light of the detecting means and smaller than a effective image width of the image forming apparatus, the first cleaning means being capable of contacting onto and separating from the transfer material carrier. Therefore, it is possible to prevent not only the surface of the transfer material carrier from becoming opaque but also the detecting means from being erroneously detected simply by arranging the first cleaning means at the same position as position of the detecting means in the axial direction of the transfer material carrier.

Moreover, the axial length of the first cleaning means is set greater than the diameter of the beam spot of the detecting means and smaller than the effective image width to ensure that at least the length equivalent to the diameter of the beam spot of the detection means is cleaned and since the axial length thereof is set smaller than the effective image width, an area equivalent to the detection means is effectively cleaned. Further, as the cleaning means is capable of contacting and separating from the transfer material carrier, the toner image transferred onto the transfer material is made free from any damage.

Further, the axial length of the first cleaning means is not greater than 20 mm, as is obvious from the tests made by present inventors, cleaning efficiency is restrained from being lowered even in a case the axial length above exceeds 20 mm with the effect of making the cleaning means compact; therefore, there is great merit in view of cost.

Moreover, the image forming apparatus further comprises a second cleaning means for cleaning the transfer material carrier over the effective image width, and first cleaning means is disposed on the upstream side of the second cleaning means. Therefore, the toner, the extraneous additive and the paper powder removed by the first cleaning means can be cleaned by the second cleaning means located on the downstream side of the first cleaning means.

Furthermore, the first cleaning means is operated in associated with a member related to feeding and peeling the transfer material on the transfer material carrier. Therefore, it is certainly prevented from causing trouble to the transfer material on the transfer material carrier without using a special member.

Still further, the image forming apparatus of the invention comprises detecting means for optically detecting a condition of an outer surface of the transfer material carrier by use of a beam spot light; and transfer material peeling means for peeling the transfer material off the transfer material carrier by contacting the surface of the transfer material carrier, the transfer material peeling means being disposed so that it linearly contacts the axial surface of the transfer material carrier at the same position as position of the detecting means in the axial direction of the transfer material carrier. Therefore, the extraneous additive of the toner, the paper power and the like are prevented from making the surface of the transfer material carrier become opaque by scraping small particles originating from the extraneous additive of the toner, the paper powder and the like sticking to the surface of the transfer material carrier using the transfer material peeling means in linear contact with the surface of the transfer material carrier, whereby it is possible to prevent the transfer material detecting means or the concentration detecting means from being erroneously detected.

What is claimed is:

1. An image forming apparatus for forming an image by successively forming a plurality of toner images different in color on an image carrier and transferring the plurality of toner images formed on the image carrier in such a manner as to superpose the toner images successively on a transfer material held on a transfer material carrier, said image forming apparatus comprising:

detecting means for optically detecting a condition of an outer surface of the transfer material carrier by use of a beam spot light; and first cleaning means for cleaning the transfer material carrier installed at the same position as position of the detecting means in an axial direction of the transfer material carrier, an axial length of the first cleaning means being greater than a diameter of the beam spot light of the detecting means and smaller than an effective image width of the image forming apparatus, the first cleaning means movably contacting onto and separating from the transfer material carrier.

2. An image forming apparatus as claimed in claim 1, wherein said detecting means comprises at least one of transfer material detecting means for detecting conditions in which the transfer material is conveyed on the transfer material carrier; and concentration detecting means for detecting toner concentration on the transfer material carrier.

3. An image forming apparatus as claimed in claim 1, wherein the axial length of the first cleaning means being not greater than 20 mm.

4. An image forming apparatus as claimed in claim 1, further comprising a second cleaning means for cleaning the transfer material carrier over the effective image width, wherein said first cleaning means is disposed on an upstream side of the second cleaning means with respect to a rotation direction of the transfer material carrier.

5. An image forming apparatus as claimed in claim 4, wherein the axial length of the first cleaning means being not greater than 20 mm.

6. An image forming apparatus as claimed in claim 1, wherein the first cleaning means is operated in associated with a member related to feeding and peeling the transfer material on the transfer material carrier.

7. An image forming apparatus as claimed in claim 6, wherein the axial length of the first cleaning means being not greater than 20 mm.

8. An image forming apparatus as claimed in claim 1, wherein the first cleaning means is provided for an auxiliary transfer member and used for cleaning an inner face of the transfer material carrier during the transfer operation.

9. An image forming apparatus as claimed in claim 1, wherein the first cleaning means is provided with an auxiliary transfer material absorption member.

10. An image forming apparatus as claimed in claim 1, wherein the first cleaning means is provided for an inside cleaning means for cleaning the transfer material carrier.

11. An image forming apparatus for forming an image by successively forming a plurality of toner images different in color on an image carrier and transferring the plurality of toner images formed on the image carrier in such a manner as to superpose the toner images successively on a transfer material held on a transfer material carrier, said image forming apparatus comprising:

detecting means for optically detecting a condition of an outer surface of the transfer material carrier by use of a beam spot light; and transfer material peeling means for peeling the transfer material off the transfer material carrier by contacting the surface of the transfer material carrier, the transfer material peeling means being disposed so that it linearly contacts an axial surface of the transfer material carrier at the same position as position of the detecting means in an axial direction of the transfer material carrier.

12. An image forming apparatus as claimed in claim 11, wherein said detecting means comprises at least one of transfer material detecting means for detecting conditions in which the transfer material is conveyed on the transfer material carrier; and concentration detecting means for detecting toner concentration on the transfer material carrier.

13. An image forming apparatus as claimed in claim 11, wherein the transfer material peeling means contacts an entire circumferential surface of the transfer material carrier during the peeling operation.

14. An image forming apparatus as claimed in claim 11, wherein the transfer material peeling means contacts a circumferential surface of the transfer material carrier only in a detection area of the detecting means.

15. An image forming apparatus for forming an image by successively forming a plurality of toner images different in color on an image carrier and transferring the plurality of toner images formed on the image carrier in such a manner as to superpose the toner images successively on a transfer material held on a transfer material carrier, said image forming apparatus comprising:

detecting means for optically detecting a condition of an outer surface of the transfer material carrier by use of a beam spot light; and auxiliary transfer material absorption member for absorbing the transfer material onto the surface of the transfer material carrier, the auxiliary transfer material absorption member being disposed so that it linearly contacts an axial surface of the transfer material carrier at the same position as position of the detecting means in an axial direction of the transfer material carrier.

16. An image forming apparatus for forming an image by successively forming a plurality of toner images different in color on an image carrier and transferring the plurality of toner images formed on the image carrier in such a manner as to superpose the toner images successively on a transfer material held on a transfer material carrier, said image forming apparatus comprising:

detecting means for optically detecting a condition of an outer surface of the transfer material carrier by use of a beam spot light; and inside peeling means for peeling the transfer material off the transfer material carrier by contacting an inner face of the transfer material carrier, the inside peeling means being disposed so that it linearly contacts an axial surface of the transfer material carrier at the same position as position of the detecting means in an axial direction of the transfer material carrier.

* * * * *